US007585230B2

(12) United States Patent
Huang

(10) Patent No.: US 7,585,230 B2
(45) **Date of Patent: *Sep. 8, 2009**

(54) SINGLE PANEL GOLF CLUB GRIP WITH EVA INSIDE LAYER

(75) Inventor: Ben Huang, P.O. Box 1936, Huntington Beach, CA (US) 92647

(73) Assignee: Ben Huang, Huntington Beach, CA (US)

( * ) Notice: Subject to any disclaimer, the term of this patent is extended or adjusted under 35 U.S.C. 154(b) by 612 days.

This patent is subject to a terminal disclaimer.

(21) Appl. No.: 10/875,035

(22) Filed: Jun. 23, 2004

(65) Prior Publication Data

US 2004/0229710 A1 Nov. 18, 2004

Related U.S. Application Data

(63) Continuation-in-part of application No. 10/746,764, filed on Dec. 23, 2003, now Pat. No. 6,843,732, and a continuation-in-part of application No. 10/392,480, filed on Mar. 18, 2003, now Pat. No. 6,857,971.

(60) Provisional application No. 60/572,604, filed on May 19, 2004.

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS

| | | | |
|---|---|---|---|
| 571,025 | A | 11/1896 | Spamer |
| 834,711 | A | 10/1906 | Clarke et al. |
| 979,266 | A | 12/1910 | Dean |
| 1,008,604 | A | 11/1911 | Lake |
| 1,017,565 | A | 2/1912 | Lard |
| 1,139,843 | A | 5/1915 | Brown |
| 1,345,505 | A | 7/1920 | Persons |
| 1,435,088 | A | 11/1922 | Smith |
| 1,522,635 | A | 1/1925 | Kraeuter |
| 1,528,190 | A | 3/1925 | Howe |

(Continued)

FOREIGN PATENT DOCUMENTS

| | | | |
|---|---|---|---|
| CN | 2139008 | Y | 7/1993 |

(Continued)

OTHER PUBLICATIONS

European Search Report, European Application No. EP 04 25 7967, 4 pages-cites: US 2004/185958; EP 1 371 397; US2,225,839; US 6,666,777; US 5,839,983; US 5,577,722; and US 979,266.

(Continued)

*Primary Examiner*—Stephen L. Blau
(74) *Attorney, Agent, or Firm*—Knobbe Martens Olson & Bear LLP

(57) ABSTRACT

A grip for the handle of a golf club having a single panel that is wrapped about an underlisting sleeve. The inside layer is EVA and the side edges of the panel abut. The unitary grip reduces impact shock, provides a feeling of tackiness and resists the absorption of moisture.

16 Claims, 20 Drawing Sheets

U.S. PATENT DOCUMENTS

| | | | | |
|---|---|---|---|---|
| 1,617,972 | A | 2/1927 | Wallace | |
| 1,890,037 | A * | 12/1932 | Johnson | 473/300 |
| 1,943,399 | A | 1/1934 | Smith | |
| 2,000,295 | A | 5/1935 | Oldham | |
| 2,086,062 | A | 7/1937 | Bray | |
| 2,103,889 | A | 12/1937 | Brisick | |
| 2,149,911 | A | 3/1939 | East | |
| 2,206,056 | A | 7/1940 | Sheesley | |
| 2,221,421 | A | 11/1940 | Curry | |
| 2,225,839 | A | 12/1940 | Moore | |
| 2,449,575 | A | 9/1948 | Wilhelm | |
| 2,523,637 | A | 9/1950 | Stanfield et al. | |
| 2,690,338 | A | 9/1954 | Brocke | |
| 2,772,090 | A | 11/1956 | Brandon | |
| 2,934,285 | A | 4/1960 | Niehaus | |
| 2,984,486 | A | 5/1961 | Jones | |
| 3,028,283 | A | 4/1962 | Lundgren et al. | |
| 3,059,816 | A | 10/1962 | Goldstein | |
| 3,087,729 | A | 4/1963 | Sullivan | |
| 3,095,198 | A | 6/1963 | Gasche | |
| 3,140,873 | A | 7/1964 | Goodwin | |
| 3,157,723 | A | 11/1964 | Hochberg | |
| 3,311,375 | A * | 3/1967 | Onions | 473/301 |
| 3,366,384 | A | 1/1968 | Lamkin et al. | |
| 3,606,325 | A | 9/1971 | Lamkin et al. | |
| 3,857,745 | A | 12/1974 | Grausch et al. | |
| 3,922,402 | A | 11/1975 | Shimamura et al. | |
| 3,992,021 | A | 11/1976 | Tobin | |
| 4,012,039 | A | 3/1977 | Yerke | |
| 4,015,851 | A | 4/1977 | Pennell | |
| 4,052,061 | A | 10/1977 | Stewart | |
| 4,133,529 | A | 1/1979 | Gambino | |
| 4,137,360 | A | 1/1979 | Reischl | |
| 4,216,251 | A | 8/1980 | Nishimura et al. | |
| 4,284,275 | A | 8/1981 | Fletcher | |
| 4,347,280 | A | 8/1982 | Lau et al. | |
| 4,358,499 | A | 11/1982 | Hill | |
| 4,448,922 | A | 5/1984 | McCartney | |
| 4,535,649 | A | 8/1985 | Stahel | |
| 4,651,991 | A | 3/1987 | McDuff | |
| 4,662,415 | A | 5/1987 | Proutt | |
| 4,765,856 | A | 8/1988 | Doubt | |
| 4,878,667 | A | 11/1989 | Tosti | |
| 4,919,420 | A | 4/1990 | Sato | |
| 4,941,232 | A | 7/1990 | Decker et al. | |
| 4,971,837 | A | 11/1990 | Martz et al. | |
| 5,024,866 | A | 6/1991 | Goode | |
| 5,055,340 | A | 10/1991 | Matsumura et al. | |
| 5,118,107 | A | 6/1992 | Bucher | |
| 5,123,646 | A | 6/1992 | Overby et al. | |
| 5,261,665 | A | 11/1993 | Downey | |
| 5,322,290 | A | 6/1994 | Minami | |
| 5,343,776 | A | 9/1994 | Falco | |
| 5,374,059 | A | 12/1994 | Huang | |
| 5,427,376 | A | 6/1995 | Cummings et al. | |
| 5,469,601 | A | 11/1995 | Jackson | |
| 5,474,802 | A | 12/1995 | Shimoda et al. | |
| 5,480,146 | A | 1/1996 | Comer | |
| 5,485,996 | A | 1/1996 | Niksich | |
| 5,511,445 | A | 4/1996 | Hildebrandt | |
| 5,570,884 | A | 11/1996 | Carps | |
| 5,571,050 | A | 11/1996 | Huang | |
| 5,577,722 | A | 11/1996 | Glassberg | |
| 5,584,482 | A | 12/1996 | Huang | |
| 5,595,544 | A | 1/1997 | Roelke | |
| 5,611,153 | A | 3/1997 | Fisher et al. | |
| 5,611,533 | A | 3/1997 | Williams | |
| 5,624,116 | A | 4/1997 | Yeh | |
| 5,626,527 | A | 5/1997 | Eberlein | |
| 5,645,501 | A | 7/1997 | Huang | |
| 5,671,923 | A | 9/1997 | Huang | |
| 5,690,566 | A | 11/1997 | Bracho | |
| 5,695,418 | A | 12/1997 | Huang | |
| 5,730,662 | A | 3/1998 | Rens | |
| 5,730,669 | A * | 3/1998 | Huang | 473/549 |
| 5,772,524 | A | 6/1998 | Huang | |
| 5,781,963 | A | 7/1998 | Maru et al. | |
| 5,797,813 | A | 8/1998 | Huang | |
| 5,813,921 | A | 9/1998 | Huang | |
| 5,816,933 | A | 10/1998 | Huang | |
| 5,827,129 | A | 10/1998 | Huang | |
| 5,839,983 | A | 11/1998 | Kramer | |
| 5,851,632 | A | 12/1998 | Chen et al. | |
| 5,857,929 | A | 1/1999 | Huang | |
| 5,867,868 | A | 2/1999 | Ward | |
| 5,890,260 | A | 4/1999 | Gaunt | |
| 5,890,972 | A | 4/1999 | Huang | |
| 5,895,329 | A | 4/1999 | Huang | |
| 5,910,054 | A | 6/1999 | Huang | |
| 5,924,941 | A | 7/1999 | Hagey | |
| 5,997,421 | A | 12/1999 | Huang | |
| 6,036,607 | A * | 3/2000 | Finegan | 473/206 |
| 6,048,275 | A | 4/2000 | Gedeon | |
| 6,197,392 | B1 | 3/2001 | Jones | |
| 6,226,836 | B1 | 5/2001 | Yasui | |
| 6,244,975 | B1 | 6/2001 | Huang | |
| 6,261,191 | B1 | 7/2001 | Chen | |
| 6,361,450 | B1 | 3/2002 | Huang | |
| 6,386,989 | B1 | 5/2002 | Huang | |
| D463,520 | S | 9/2002 | Ulrich | |
| 6,449,803 | B1 * | 9/2002 | McConchie | 16/431 |
| 6,503,153 | B2 | 1/2003 | Wang | |
| 6,506,128 | B1 | 1/2003 | Bloom, Jr. | |
| 6,551,198 | B2 | 4/2003 | Huang | |
| 6,558,270 | B2 | 5/2003 | Kwitek | |
| 6,627,027 | B2 | 9/2003 | Huang | |
| 6,629,901 | B2 | 10/2003 | Huang | |
| 6,635,688 | B2 | 10/2003 | Simpson | |
| 6,652,398 | B2 | 11/2003 | Falone et al. | |
| 6,656,054 | B2 | 12/2003 | Ulrich | |
| 6,656,057 | B2 * | 12/2003 | Manual et al. | 473/300 |
| 6,663,500 | B2 | 12/2003 | Huang | |
| 6,666,777 | B1 | 12/2003 | Lamkin et al. | |
| 6,676,534 | B2 | 1/2004 | Huang | |
| 6,709,346 | B1 | 3/2004 | Wang | |
| 6,733,401 | B1 | 5/2004 | Huang | |
| 6,827,656 | B1 | 12/2004 | Hoeflich et al. | |
| 6,843,732 | B1 | 1/2005 | Huang | |
| 6,857,971 | B2 | 2/2005 | Huang | |
| 6,908,400 | B2 | 6/2005 | Chu et al. | |
| 7,048,644 | B2 | 5/2006 | Wang | |
| 7,137,904 | B2 | 11/2006 | Huang | |
| 7,186,189 | B2 | 3/2007 | Huang | |
| 7,195,568 | B2 | 3/2007 | Huang | |
| 7,219,395 | B2 | 5/2007 | Bigolin | |
| 7,344,447 | B2 | 3/2008 | Chang | |
| 7,344,448 | B2 | 3/2008 | Huang | |
| 7,404,770 | B2 | 7/2008 | Huang | |
| 7,448,957 | B2 | 11/2008 | Huang | |
| 7,448,958 | B2 | 11/2008 | Huang | |
| 7,458,903 | B2 | 12/2008 | Wang, et al. | |
| 7,470,199 | B2 | 12/2008 | Huang | |
| 2002/0028325 | A1 | 3/2002 | Simpson | |
| 2002/0142858 | A1 | 10/2002 | Chen | |
| 2002/0142900 | A1 | 10/2002 | Wang | |
| 2002/0173371 | A1 | 11/2002 | Lamkin et al. | |
| 2003/0040384 | A1 | 2/2003 | Falone et al. | |
| 2003/0045370 | A1 | 3/2003 | Jaw | |
| 2003/0062654 | A1 | 4/2003 | Lamkin | |
| 2003/0139223 | A1 | 7/2003 | Ulrich et al. | |
| 2003/0148836 | A1 | 8/2003 | Falone et al. | |
| 2003/0150081 | A1 | 8/2003 | Wang | |
| 2003/0216192 | A1 | 11/2003 | Chu | |
| 2003/0228930 | A1 | 12/2003 | Huang | |

| | | | | |
|---|---|---|---|---|
| 2004/0029645 | A1* | 2/2004 | Chen | 473/300 |
| 2004/0029646 | A1 | 2/2004 | Chu et al. | |
| 2004/0031128 | A1 | 2/2004 | Chen | |
| 2004/0109980 | A1 | 6/2004 | Chen et al. | |
| 2004/0123429 | A1* | 7/2004 | Wang | 16/436 |
| 2004/0185958 | A1 | 9/2004 | Huang | |
| 2005/0276925 | A1 | 12/2005 | Su | |
| 2007/0149307 | A1 | 6/2007 | Huang | |

FOREIGN PATENT DOCUMENTS

| | | | |
|---|---|---|---|
| CN | 2163667 | Y | 5/1994 |
| CN | 2288744 | | 8/1998 |
| CN | 1332022 | A | 7/2000 |
| CN | 2438768 | | 7/2001 |
| CN | 2444645 | | 8/2001 |
| CN | 02254450.X | | 9/2002 |
| EP | 1 371 397 | | 12/2003 |
| GB | 2 264 062 | | 8/1993 |
| JP | 7-41731 | | 2/1995 |
| JP | 3081404 | | 8/2001 |
| JP | 2002-028264 | | 1/2002 |
| WO | WO 2005/115563 | A1 | 12/2005 |

OTHER PUBLICATIONS

Partial European Search Report, App. No. EP 03 25 5917, 2 pages-cites: 5,671,923; 4,765,856; US 2002/173371; US 2003/040384; and 5,571,050.
U.S. Appl. No. 10/167,216, filed Jun. 11, 2002, pending.
U.S. Appl. No. 10/875,035, filed Jun. 23, 2004, pending.
U.S. Appl. No. 11/029,328, filed Jan. 5, 2005, pending.
U.S. Appl. No. 11/131,832, filed May 18, 2005, pending.
U.S. Appl. No. 11/172,770, filed Jul. 1, 2005, pending.
Docket Sheet for U.S. District Court- Central District of California (Southern Division- Santa Ana) Civil Docket for Case #:8:05-CV-00168 CJC (RNBx) entitled *Winn, Inc., et al.* v *Karakal Far East Ltd., et al.*
Stipulated Preliminary Injunction Filed Mar. 14, 2005.
Answer of Defendants Karakal Far East Ltd. and High Cedar Enterprises Co., Ltd. Filed Apr. 13, 2005.
Memorandum of Points and Authorities in Support of Plaintiff's Motion for A Preliminary Injunction Filed Feb. 28, 2005.
Declaration of Ben Huang in Support of Plaintiff's Motion for A Preliminary Injunction Filed Feb. 28, 2005.
Declaration of Charles A. Garris in Support of Plaintiffs' Motion for Preliminary Injunction Filed Feb. 28, 2005.
Initial Disclosures of Plaintiffs Winn Incorporated and Ben Huang Filed May 9, 2005.
Initial Disclosures of Defendants High Cedar Enterprises, Co. Ltd. and Karakal Far East Ltd. Filed May 9, 2005.
U.S. Appl. No. 10/608,598, filed Jun. 27, 2003, pending.
U.S. Appl. No. 10/785,379, filed Feb. 24, 2004, pending.
U.S. Appl. No. 10/827,095, filed Apr. 19, 2004, pending.
U.S. Appl. No, 11/062,046, filed Feb. 18, 2005, pending.
Partial European Search Report, App. No. EP 03 25 5917, 2 pages.
U.S. Appl. No. 11/412,196, filed Apt. 25, 2006, pending.
U.S. Appl. No. 11/416,364, filed May 1, 2006, pending.
U.S. Appl. No. 11/413,411, filed Apr. 28, 2006, pending.
U.S. Appl. No. 11/438,808, filed May 22, 2006, pending.
U.S. Appl. No. 11/417,643, filed May 3, 2006, pending.
U.S. Appl. No. 11/417,696, filed May 3, 2006, pending.
U.S. Appl. No. 11/417,623, filed May 3, 2006, pending.
U.S. Appl. No. 11/417,555, filed May 3, 2006, pending.
U.S. Appl. No. 11/417,401, filed May 3, 2006, pending.
U.S. Appl. No. 11/682,264, filed Mar. 5, 2007, (U.S. Pub. No. 2007-0149307 A1), pending (180C1).
U.S. Appl. No. 11/689,452, filed Mar. 21, 2007, pending (214A).
U.S. Appl. No. 12/045,639, filed Mar. 10, 2008, pending (212A).
U.S. Appl. No. 11/838,670, filed Aug. 14, 2007, pending (217A).
U.S. Appl. No. 12/055,289, filed Mar. 25, 2008, pending (207C).
U.S. Appl. No. 12/123,384, filed May 19, 2008, pending (11CP5DV1C1).
Order Granting Request Inter Partes Reexamination, dated Jul. 16, 2007, from U.S. PTO, Jeffrey R. Jastrzab, Primary Examiner, from U. S. Appl. No. 95/000,234.
Office Action in Inter Partes Reexamination, dated Jul. 16, 2007, from U.S. PTO, Jeffrey R. Jastrzab, Primary Examiner, from U. S. Appl. No. 95/000,234.
Declaration In Support Of The Supplement To The Petition For Termination Of Reexamination Proceedings, dated Sep. 13, 2007.
Statement regarding Re-submission of Previously Filed Documents, dated Sep. 4, 2007.

* cited by examiner

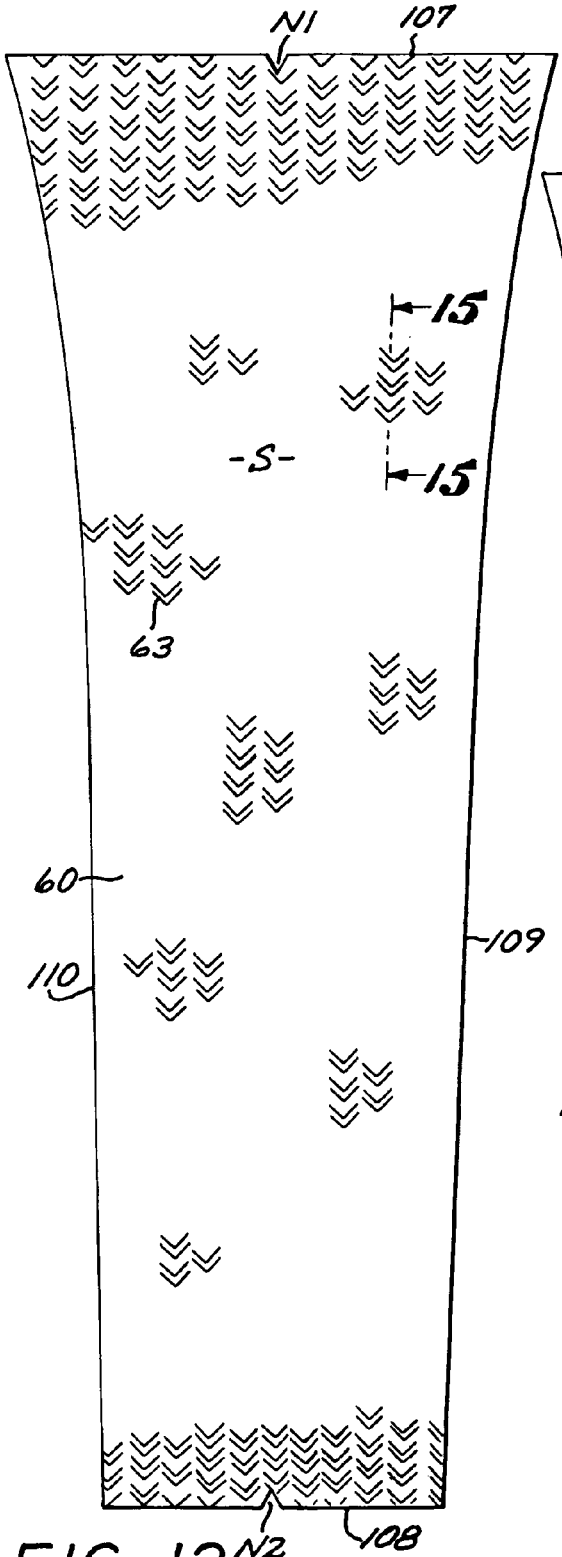
FIG. 12
FIG. 13
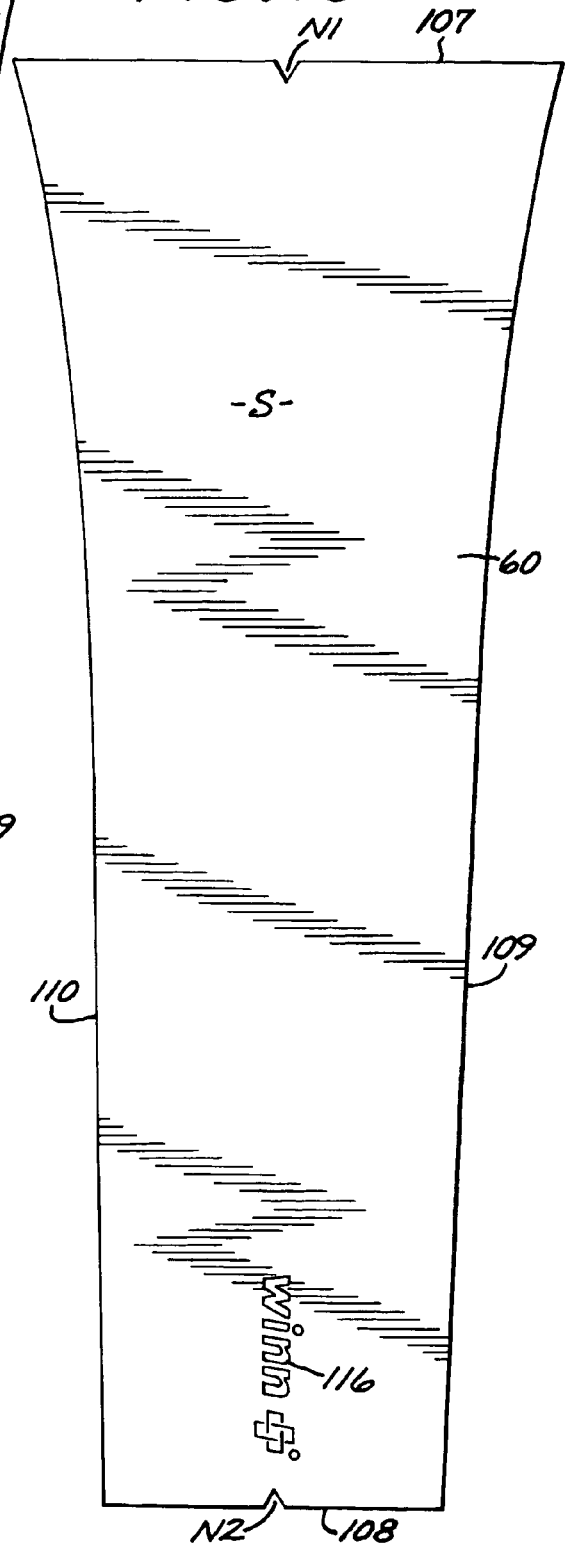

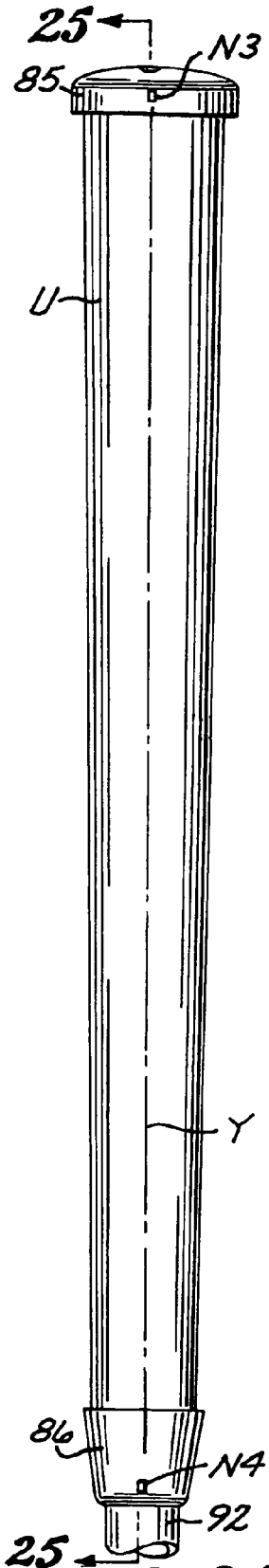
FIG. 24
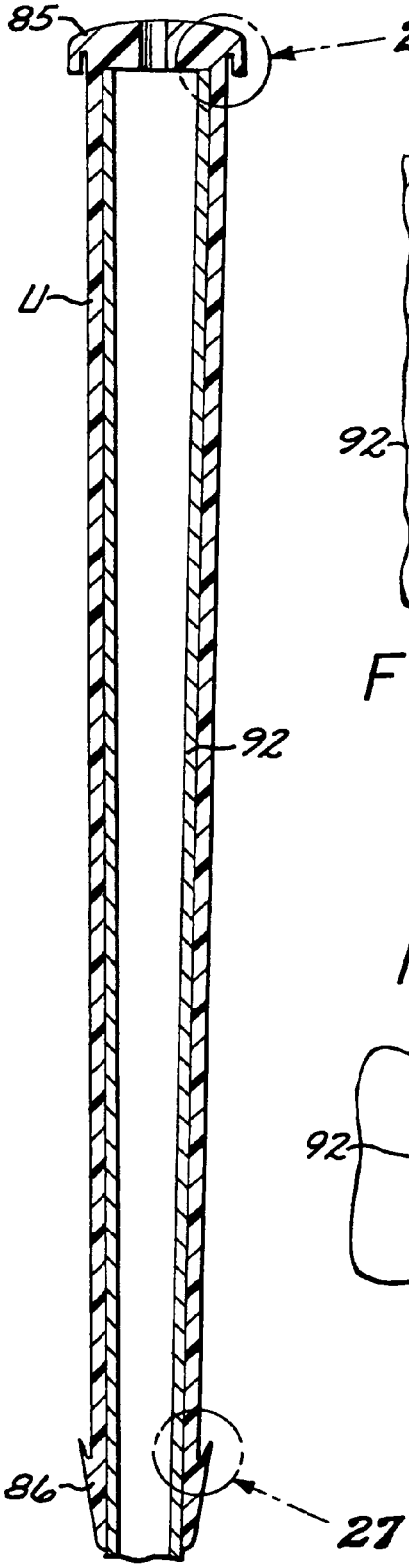
FIG. 25
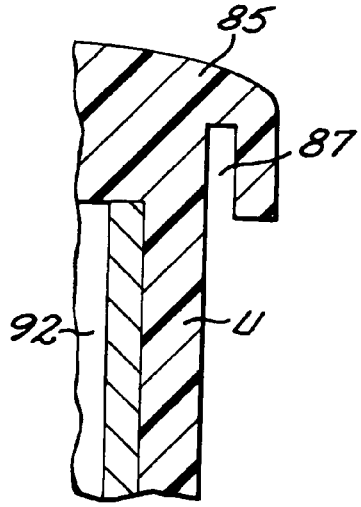
FIG. 26
FIG. 27
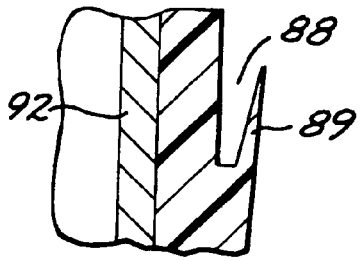

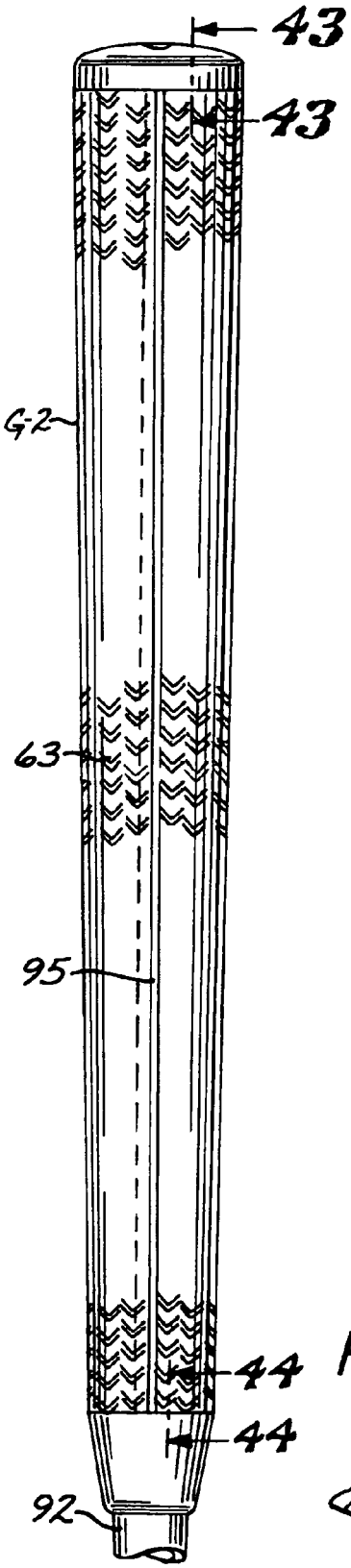
FIG.42
FIG.43
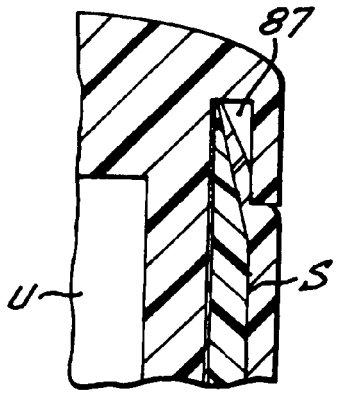
FIG.44
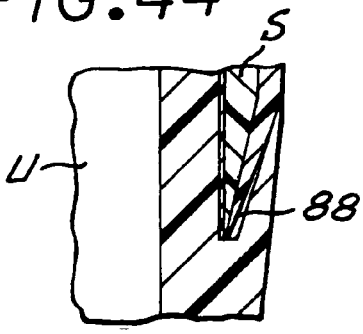
FIG.47
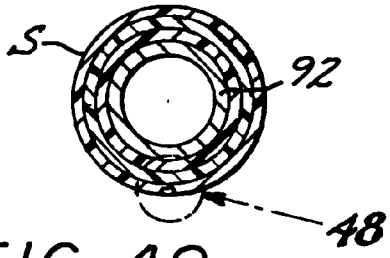
FIG.48
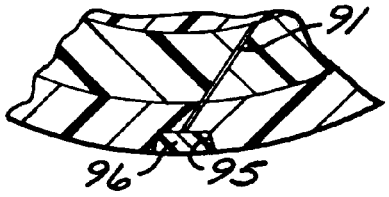
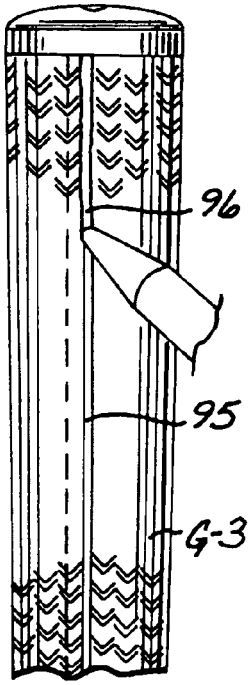
FIG.45
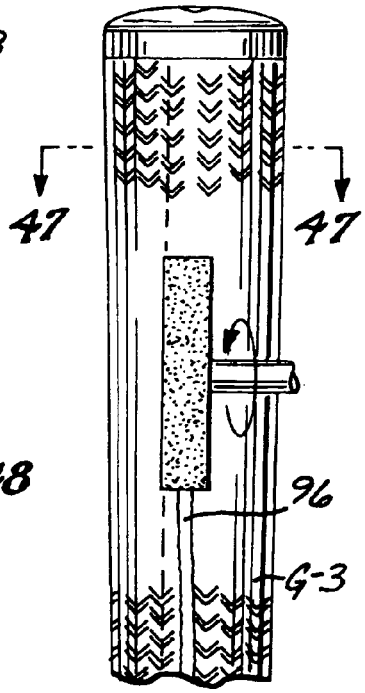
FIG.46

92
60
60
61
61
100
M3
100
63a
91
60
62
U
100
5
62
100
63a
G-5
63
55

SINGLE PANEL GOLF CLUB GRIP WITH EVA INSIDE LAYER

RELATED U.S. APPLICATION DATA

This application is a continuation-in-part of U.S. patent application Ser. No. 10/392,480, filed Mar. 18, 2003, now U.S. Pat. No. 6,857,971, and a continuation-in-part of U.S. patent application Ser. No. 10/746,764, filed Dec. 23, 2003, now U.S. Pat. No. 6,843,732. This application claims priority to U.S. Provisional Application No. 60/572,604 filed May 19, 2004.

INCORPORATION BY REFERENCE

This application hereby incorporates by reference U.S. patent application Ser. No. 10/392,480, filed Mar. 18, 2003; U.S. patent application Ser. No. 10/746,764, filed Dec. 23, 2003; U.S. patent application Ser. No. 10/445,786, filed May 27, 2003; U.S. Pat. No. 6,627,027, issued Sep. 30, 2003; and U.S. Provisional Application No. 60/572,604, filed May 19, 2004, in their entireties.

BACKGROUND OF THE INVENTION

1. Field of the Invention

The present invention relates to an improved grip for golf clubs.

2. Description of Prior Art

Applicant has previously developed resilient grips which successfully reduce impact shock to the muscle and arm joints of the user's of golf clubs and also provide a feeling of tackiness between a player's hands and the grip. See for example U.S. Pat. No. 5,797,813 granted to Applicant on Aug. 25, 1998. Such earlier grips utilize a polyurethane-felt strip which is spirally wrapped around an underlisting sleeve that is slipped onto and adhered to a golf club handle. The sides of the strips are formed with overlapping heat depressed recessed reinforcement edges. While such grips have proven satisfactory in reducing impact shock, their fabrication is labor intensive, particularly since the strip must be wrapped manually about the underlisting sleeve within specific pressure parameters. Additionally, it is difficult to accurately align the adjoining side edges of the strip as such strip is being spirally wrapped about underlisting sleeve. The strip of such wrapped grips can become twisted during the wrapping process. This is a particularly difficult problem when wrapping putter grips. These wrapped grips also do not lend themselves to the display of decorative designs.

While prior art polyurethane/felt grips have been developed that provide the desired shock absorption properties, the felt material is prone to absorbing water. Accordingly, the grip will tend to absorb the perspiration from the user's hand and may become saturated during play thereby causing slippage of the golf club or tennis racquet in the user's hands. The same problem occurs under wet conditions such as when playing golf in the rain. In an effort to address this problem, Applicant has used EVA (ethylene-vinyl acetate copolymer) as a substitute for the felt substrate. See, for example, U.S. Pat. No. 6,627,027 granted to Applicant on Sep. 30, 2003.

SUMMARY OF THE INVENTION

In one embodiment, the golf club grip overcomes the aforementioned disadvantages of existing spirally wrapped grips while providing the same resistance to shock afforded by such grips, as well as providing tackiness, reducing the overall weight of the grip and providing a resistance to absorbing water which can impair the above-mentioned advantages. The disadvantages are eliminated by forming a structurally integral grip from a single polyurethane-EVA panel having a configuration corresponding to the exterior shape of an underlisting sleeve. The side edges of such single panel abut one another and, preferably, are adhered together to define a longitudinal seam extending through the panel. A heat formed recessed sealing channel may be formed in the exterior portion of the polyurethane layer at the outer end of the seam to strengthen such seam. Hot polyurethane is deposited along the seam or within the channel, and after such polyurethane has hardened it is buffed to smoothly blend into the surface of the grip. In another modification, a mold is utilized to emboss a friction enhancing pattern over the deposited polyurethane to match the friction enhancing pattern of the main body of the surface of the grip.

Another embodiment is a grip for the handle of a golf club including an underlisting sleeve and a single panel. The underlisting sleeve is telescopically slipped onto the handle of a golf club. The single panel includes a polymeric outside layer bonded to a polymeric inside layer. The panel is wrapped about and adhered to the underlisting sleeve with the side edges of the panel abutting one another to define a longitudinal seam extending from the interior surface of the inside layer to the exterior surface of the outside layer. Preferably, the side edges are adhered together. In another embodiment, a polymeric material is deposited along the seam. In another embodiment, a heat depressed channel is formed exteriorially of the seam. In another embodiment, the channel is filled with a polymeric deposit. In yet another embodiment, the polymeric deposits are smooth buffed. In yet another embodiment, a segment of friction enhancing pattern is formed outwardly of the seam so as to merge the friction enhancing pattern formed on the outside of the outside layer.

Another embodiment is a method of making a grip for the handle of a golf club including the following steps: providing an underlisting sleeve that is telescopically slipped onto the handle of a golf club, providing a single panel that includes a polyurethane outside layer bonded to an EVA inside layer, wherein the panel has a configuration corresponding to the exterior shape of the resilient sleeve, wrapping the single panel about and adhering it to the underlisting sleeve and abutting the side edges of the panel together to define a longitudinal seam extending from the interior surface of the inside layer to the exterior surface of the outside layer.

The golf club grip may be manufactured at considerably less cost than existing spirally wrapped grips, since the intensive labor of spirally wrapping a strip around an underlisting sleeve within specific pressure parameters is eliminated. Additionally, the single panel grip will desirably not twist either during manufacture or after it is adhered to an underlisting sleeve. My new grip desirably has an appearance similar to conventional molded rubber grips so as to appeal to professional golfers and low-handicap amateurs, and desirably also provides a greater area for the application of decorative designs. Further, the EVA inside layer of my new grip will resist the absorption of water to preserve the other advantages provided by the grip when the grip is exposed to moisture.

These and other objects and advantages will become apparent from the following detailed description when taken in conjunction with the accompanying drawings.

BRIEF DESCRIPTION OF THE DRAWINGS

FIG. 12 is a front view of the polyurethane-EVA single panel after it has been removed from the mold shown in FIG. 7;

FIG. 13 is a front view of the polyurethane-EVA single panel after it has been removed from another version of the mold shown in FIG. 7;

FIG. 24 is a front view of an underlisting sleeve member of the polyurethane-EVA single panel grip of the present invention;

FIG. 25 is a vertical cross-sectional view taken along the line designated 25-25 of FIG. 24;

FIG. 26 is an enlarged view of the encircled area designated 26 in FIG. 25;

FIG. 27 is an enlarged view of the encircled area designated 27 in FIG. 25;

FIG. 42 is a front view of a completed polyurethane-EVA single panel grip according to an embodiment of the present invention;

FIG. 43 is a vertical cross-sectional view taken along the line designated 43-43 of FIG. 42;

FIG. 44 is a vertical cross-sectional view taken along the line designated 44-44 of FIG. 42;

FIG. 45 is a broken front view showing a first step in making a modification of the grip of FIG. 42;

FIG. 46 is a broken front view showing a second step in making a modification of the grip of FIG. 42;

FIG. 47 is a horizontal cross-sectional view taken along the line designated 47-47 of FIG. 46;

FIG. 48 an enlarged view of the encircled area designated 48 in FIG. 47;

DETAILED DESCRIPTION OF THE PREFERRED EMBODIMENT

Figure 1:
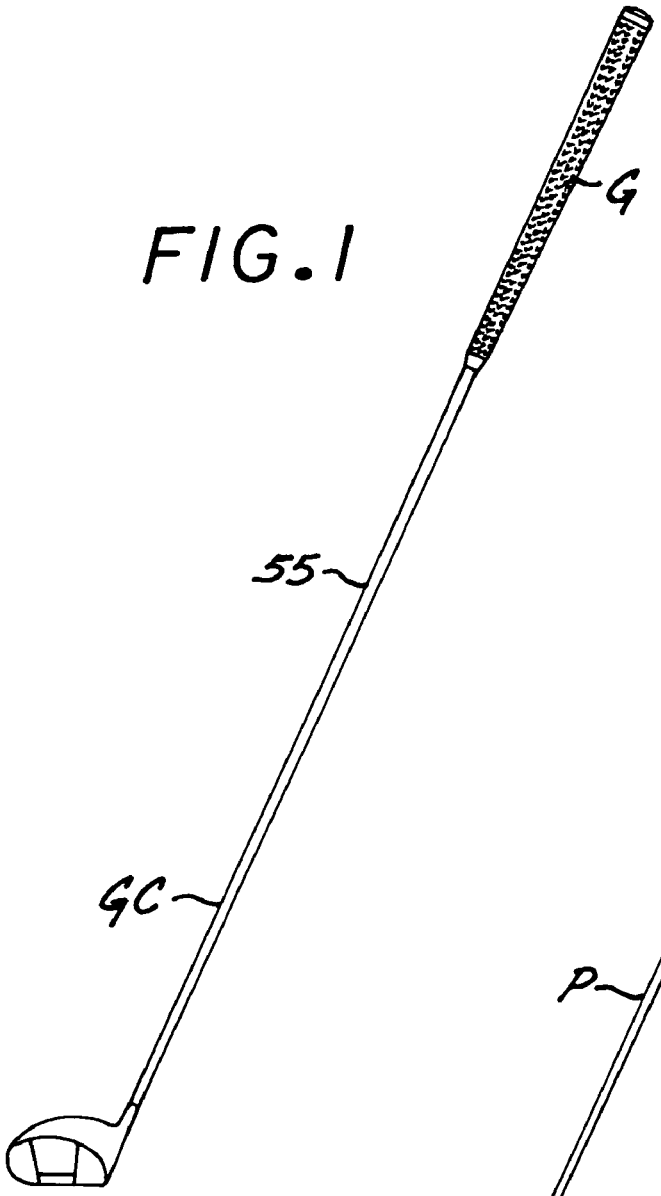
FIG. 1 is a perspective view of a golf club provided with a polyurethane-EVA single panel grip according to an embodiment of the present invention.
Figure 2:
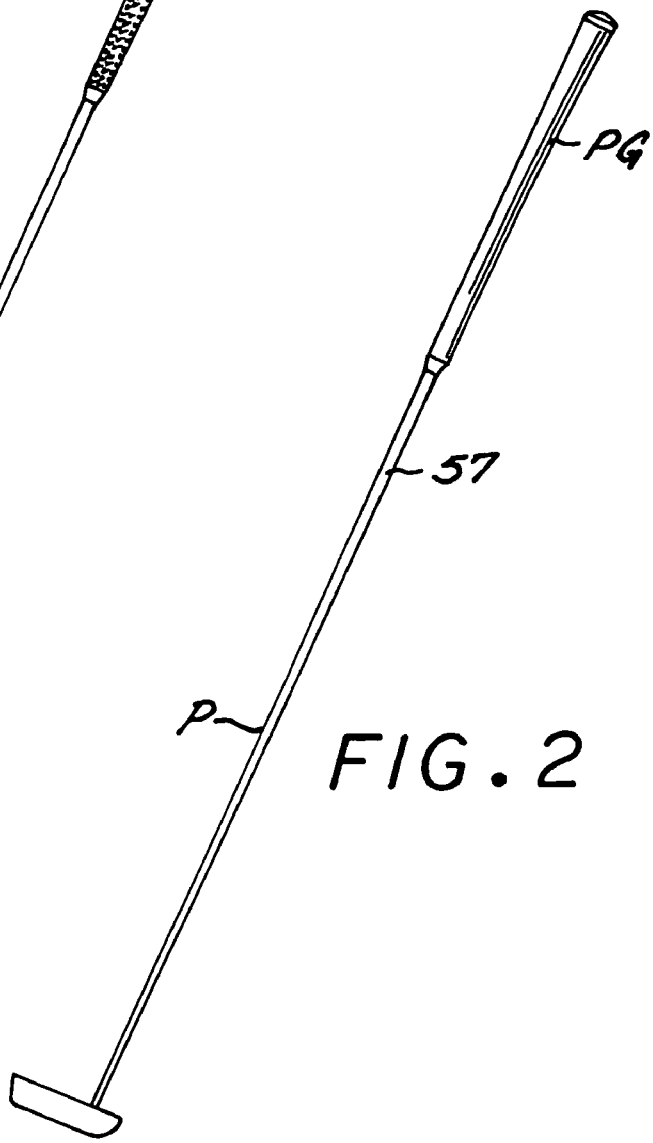
FIG. 2 is a perspective view showing a putter provided with a polyurethane-EVA single panel grip according to an embodiment of the present invention.
Figure 3:
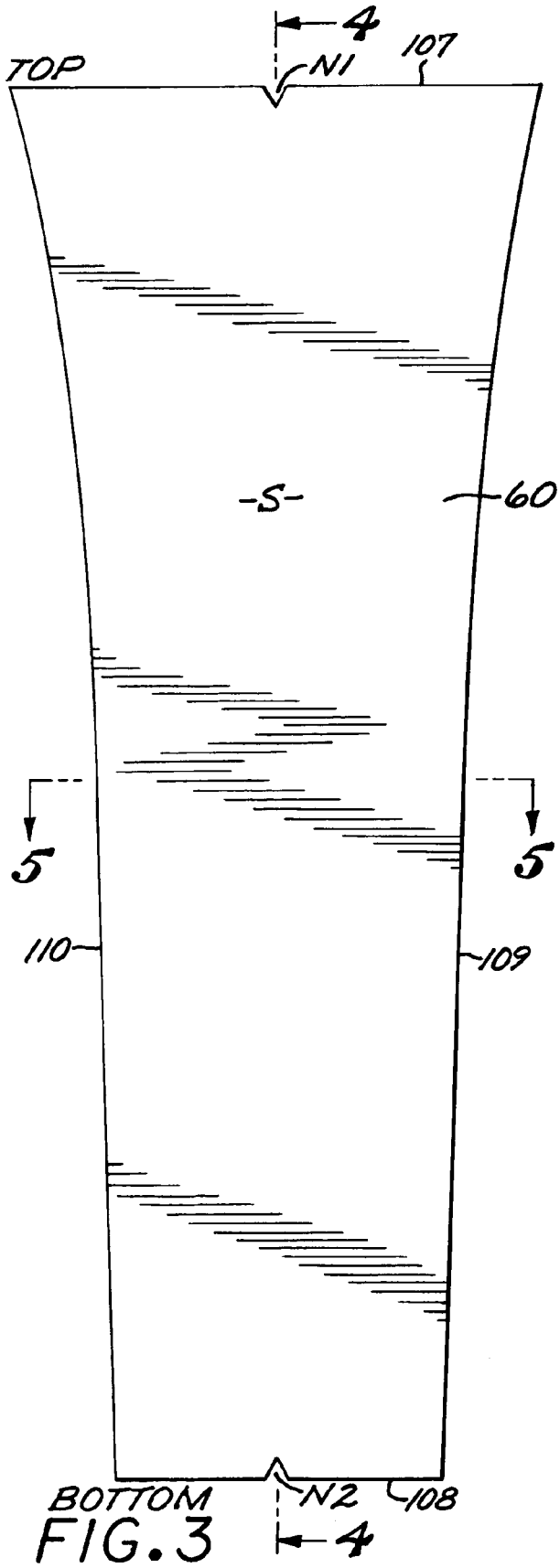
FIG. 3 is a front view of the polyurethane-EVA single panel after being press cut to its final working shape.
Figure 4:
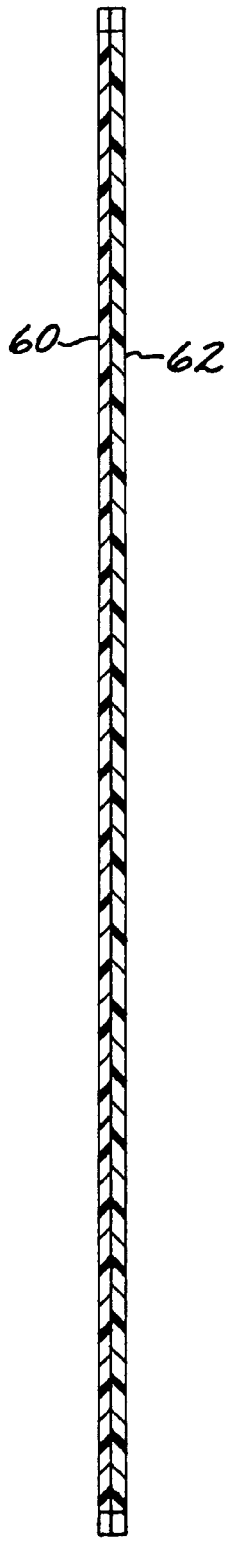
FIG. 4 is a vertical cross-sectional view taken along the line designated 4-4 of FIG. 3.
Figure 5:
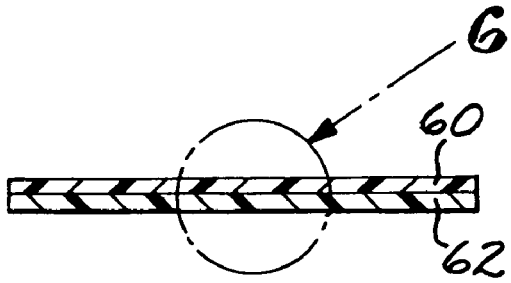
FIG. 5 is a horizontal cross-sectional view taken along the line designated 5-5 of FIG. 3.

Referring to the drawings, in FIG. 1, a single panel grip G of one embodiment of the present invention is shown attached to the shaft 55 of a golf club GC. In FIG. 2, a single panel putter grip PG is shown attached to the shaft 57 of a putter P. Referring now to the remaining drawings, a preferred form of grip G includes a single panel S formed of a bonded-together outside or polymeric, preferably polyurethane, layer 60 and an inside or polymeric, preferably ethylene-vinyl acetate copolymer (EVA), layer 62, which is wrapped about and adhered to a resilient underlisting sleeve U of conventional construction.

The outside layer 60 of the single panel in this disclosure is generally referred to as a polyurethane layer. Though polyurethane is the preferred material, other materials could be used and achieve some advantages. In particular, other polymeric compounds can be used to create the outer layer and achieve some advantages. Similarly, the inside layer 62 is generally referred to as an EVA layer. Though EVA is preferred, it is understood that other polymeric layers can be used in alternative embodiments of this invention.

Figure 6:
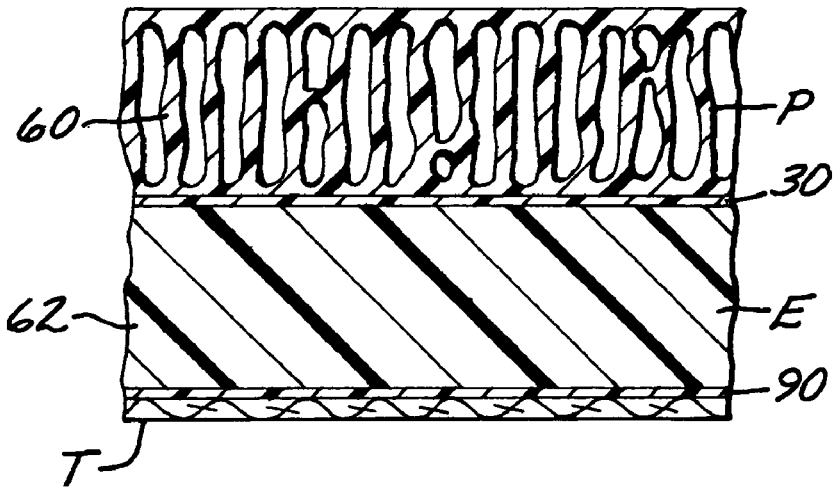
FIG. 6 is an enlarged view of the encircled area designated 6 in FIG. 5.
Figure 7:
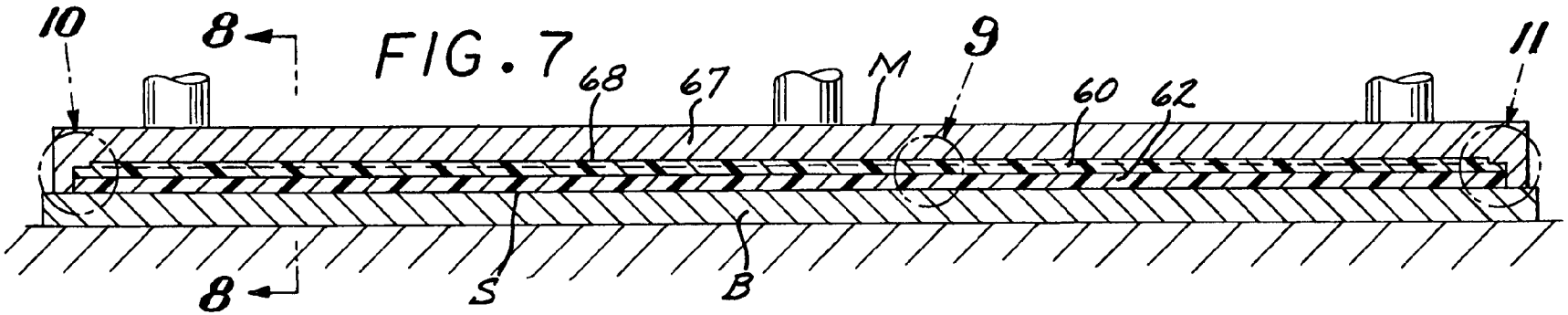
FIG. 7 is a side view showing a first mold which may be utilized in forming a polyurethane-EVA single panel grip.

Referring to FIGS. 3-6, the EVA layer 62 has its exterior surface secured to the interior surface of polyurethane layer 60 with an adhesive 30, with such polyurethane layer 60 preferably being coagulated to define pores (as shown in FIG. 6). One preferred method of forming a suitable polyurethane-EVA sheet (not-shown) is disclosed in U.S. Pat. No. 6,627,027 issued to Applicant on Sep. 30, 2003. One preferred method of forming the polyurethane layer 60 of the aforementioned polyurethane-EVA sheet is disclosed in, for example, U.S. patent application Ser. No. 10/746,764, filed by Applicant on Dec. 23, 2003. Once the polyurethane-EVA sheet is formed, the sheet is preferably press cut in the conventional way to form the shaped panel S shown in FIG. 3. The same press cut desirably also forms notches N1, N2 in the panel S at the center of the top edge 107 and bottom edge 108, respectively. The notches N1, N2 serve as markings to help center the panel S on the underlisting sleeve U. Though there are other methods of centering the panel S, these notches N1, N2 are preferred because they reduce cost and do not affect the contours of the finished grip G. One example of another method of centering the panel S is discussed below in relation to FIGS. 16-19.

Preferably, the thickness of the polyurethane layer will be about 0.3-0.5 millimeters and the thickness of the EVA layer about 0.8-1.7 millimeters. The polyurethane layer 60 provides a cushioned grasp of a golfer's hands on a golf club and also enhances the golfer's grip by providing increased tackiness between the player's hand and the grip. The EVA layer 62 provides strength to the polyurethane layer and serves as a moisture resistant means for attaching the secured-together polyurethane and EVA panel to underlisting sleeve U.

Figure 9:
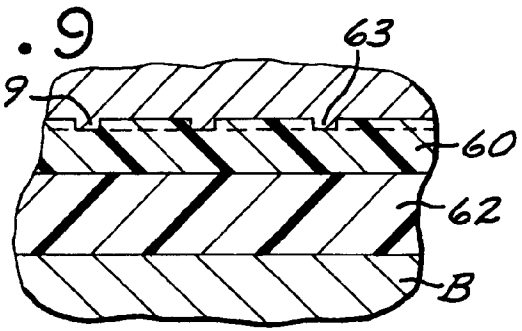
FIG. 9 is an enlarged view of the encircled area designated 9 in FIG. 7.
Figure 11:
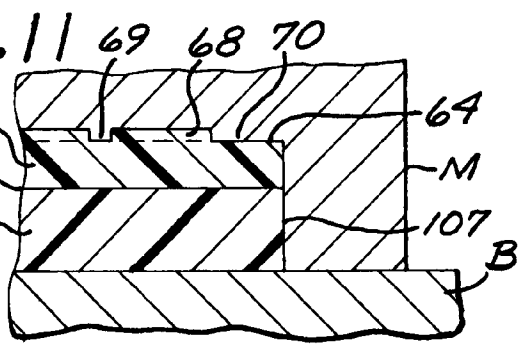
FIG. 11 is an enlarged view of the encircled area designated 11 in FIG. 7.
Figure 8:
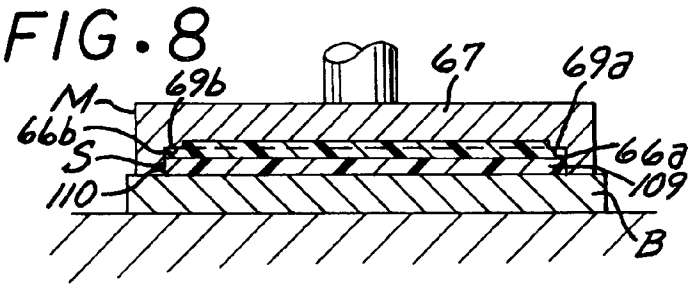
FIG. 8 is a vertical cross-sectional view taken along the line designated 8-8 of FIG. 7.
Figure 10:
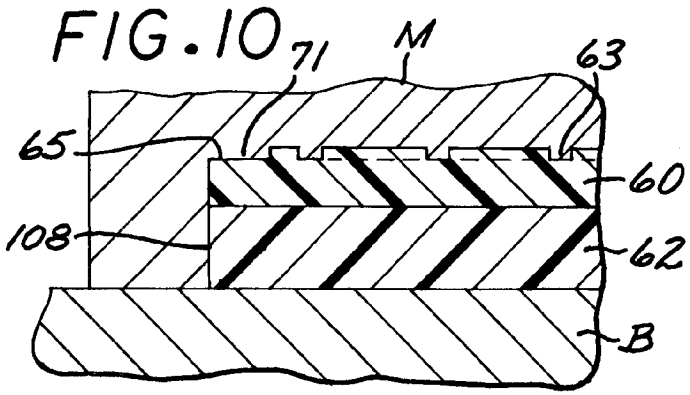
FIG. 10 is an enlarged view of the encircled area designated 10 in FIG. 7.

Referring now to FIGS. 7-15 there is shown a first mold M which may be utilized to form a friction enhancing pattern 63 on the outer surface of polyurethane layer 60, and top and bottom heat depressed horizontal edges 64 and 65 along the top and bottom edges 107, 108 of the single panel S and depressed horizontal edges 66*a*, 66*b* along the sides of the panel 109, 110, respectively. Mold M includes a base plate B and a heated platen 67 formed with a cavity 68. The ends of the cavity 68 are provided with depending protrusions 69 that engage the outer surface of the polyurethane layer 60 so as to form the depressed friction enhancing pattern 63, as seen in FIG. 9. In FIG. 8, depending protrusions 69*a*, 69*b* form recessed edges 66*a*, 66*b*, respectively. In FIG. 11, it will be seen that the right-hand edge of the cavity 68 is formed with a shoulder 70 which engages the top edge 107 of the panel S to form heat recessed top edge 64 in polyurethane layer 60. The left-hand side of the cavity is formed with a similar shoulder 71 to form the heat depressed recessed bottom edge 65 along the bottom edge 108 of the panel S (FIG. 10).

Figure 14:
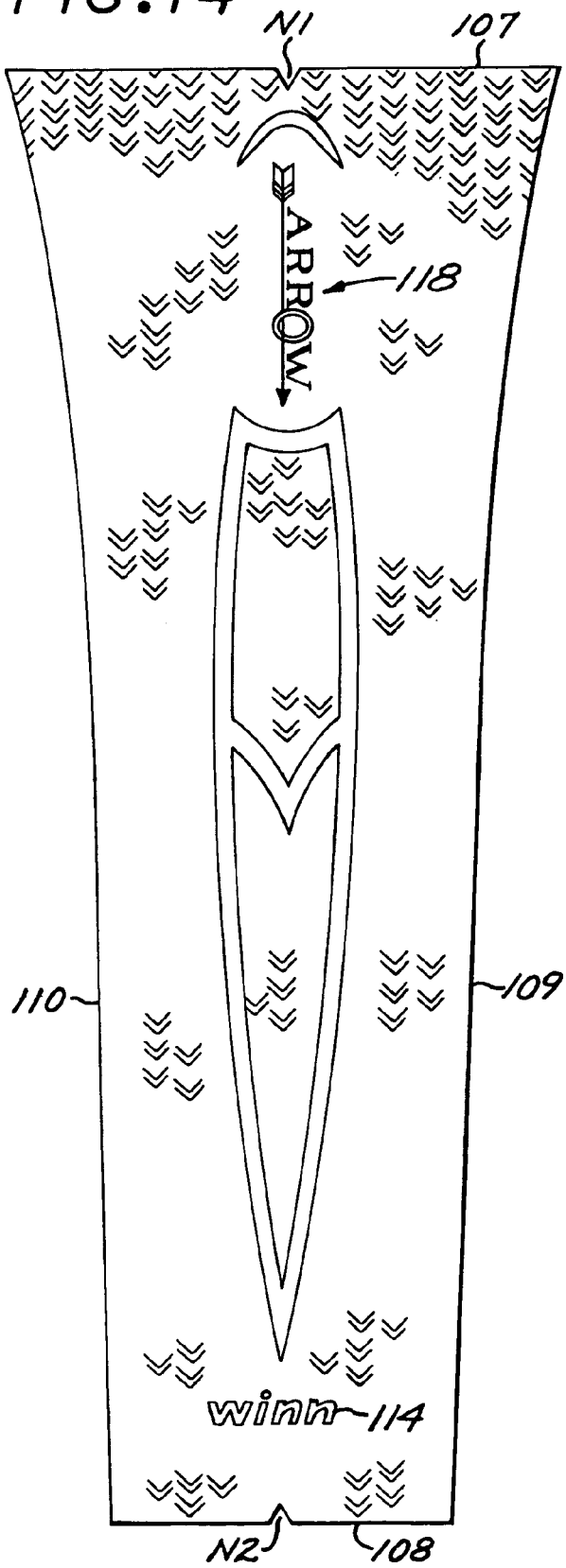
FIG. 14 is a front view of the polyurethane-EVA single panel after it has been removed from another version of the mold shown in FIG. 7.

In alternative embodiments, other patterns may be formed on the outer surface of the polyurethane layer 60. FIG. 12 shows one alternative design in which the mold M forms the friction enhancing pattern 63 but does not form the heat depressed edges 64, 65, 66*a*, 66*b* along the periphery edges 107, 108, 109, 110 of the panel S. As seen in FIG. 13, another alternative design leaves the majority of the outside layer 60 smooth while visual indicia, such as logo 116, is placed near the bottom edge 108 of the panel S. In FIG. 14, yet another embodiment of the friction enhancing pattern is shown. The second pattern 118 incorporates visual indicia extending the majority of the length of the panel surrounded by a tread pattern similar to the friction enhancing pattern 63 shown in FIG. 12. FIG. 14 also shows an alternative means for imputing decorative designs or logos on the grip panel S. Stamped visual indicia, such as logo 114, is ink stamped onto the polyurethane layer 60 using a suitable ink known to those of skill in the art. Preferably, the ink is waterproof and heat resistant and, more preferably, formulated to resist degradation when coming into contact with the lubrication fluid or solvent used to apply the completed grip G (underlisting U with panel S) over the end of a golf club GC shaft 55 (FIG. 1) or a putter P shaft 57 (FIG. 2). It is to be understood that these are representative and many other patterns and stamps may be used with this polyurethane-EVA single panel grip.

Figure 15:
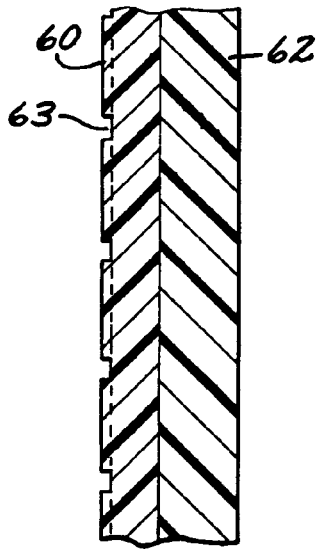
FIG. 15 is a vertical cross-sectional view taken along the line designated 15-15 of FIG. 12.
Figures 16, 17, 18, 19:
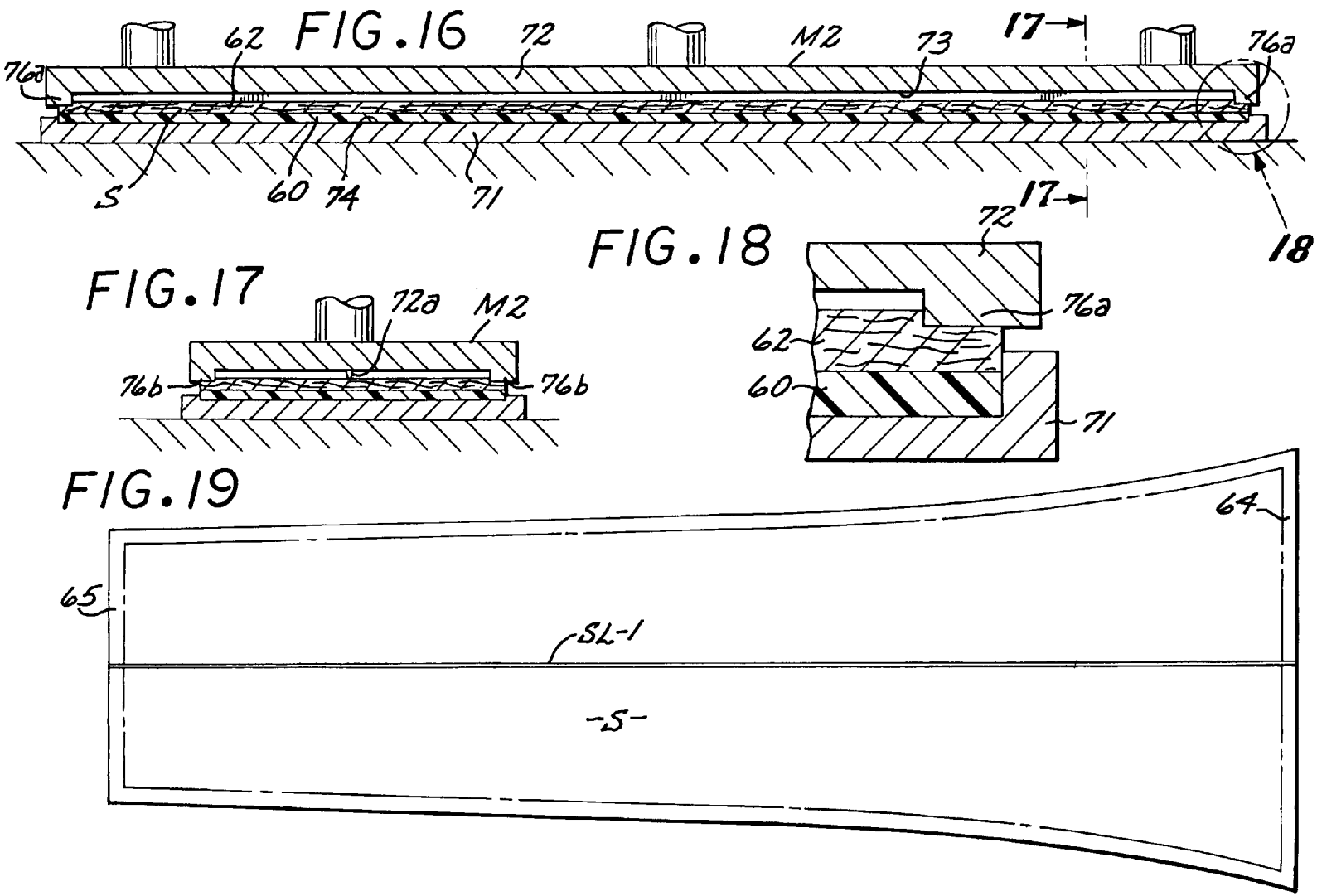
FIG. 16 is a side view showing another mold which may be utilized in forming a polyurethane-EVA single panel grip.
FIG. 17 is a vertical cross-sectional view of the mold taken along the line designated 17-17 of FIG. 16.
FIG. 18 is an enlarged view of the encircled area designated 18 in FIG. 16.
FIG. 19 is a front view of the interior surface of the polyurethane-EVA single panel after it has been removed from one version of the mold shown in FIG. 16.

FIG. 15 is a cross-sectional view taken along the line designated 15-15 of FIG. 12. It shows the friction enhancing pattern 63 formed on the contiguous polyurethane layer 60.

Referring now to FIGS. 16-19 there is shown a second mold M2 which may be utilized in making a single panel grip G of one embodiment of the present invention. Panel S is shown inverted from its position in first mold M. The mold M2 includes a base plate 71 and a heated platen 72 formed with a cavity 73. The base plate is also formed with a cavity 74 that receives the polyurethane layer 60 while the EVA layer 62 is received within the cavity 73 of the heated platen 72. The top and bottom edges and the side edges of the heated platen 72 are formed with a depending peripheral shoulders 76*a*, 76*b* that engage the top and bottom edges 107, 108 and the side edges 109, 110 of the EVA layer 62. When the heated platen 72 is urged downwardly towards the EVA layer the periphery thereof will be depressed by the shoulders 76*a*, 76*b* and heat will be transferred through the EVA layer to densify the peripheral edges of the polyurethane layer 60. The densification is effected by the heat transferred from the shoulders 76*a*, 76*b* through the EVA layer 62. An alternative to the centering notches N1, N2 can be formed at the same time when heated platen 72 of second mold M2 is also provided with a depending spur 72*a* (FIG. 17) which forms a score line SL-1 along the longitudinal center of the EVA layer 62 shown in FIG. 19. In alternative embodiments, the heated platen of second mold M2 lacks depending shoulders 76*a*, 76*b*. Rather, it only has depending spur 72*a* to form score line SL-1 without densifying the peripheral edges 107, 108, 109, 110 of polyurethane layer 60

Figure 20:
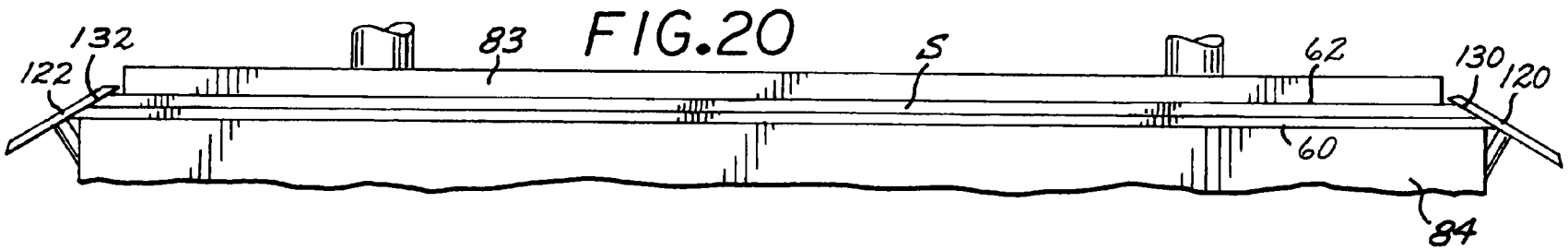
FIG. 20 shows the top and bottom edges of the polyurethane-EVA single panel being skived.
Figure 22:
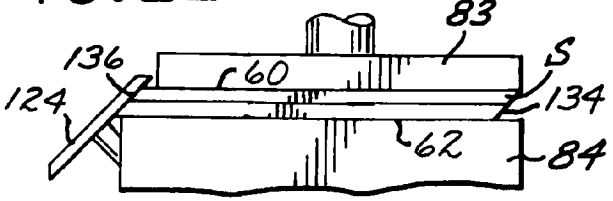
FIG. 22 shows a second side edge of the polyurethane-EVA single panel being skived.
Figure 21:
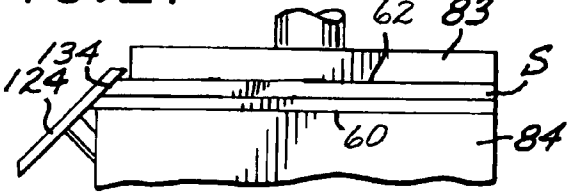
FIG. 21 shows a first side edge of the polyurethane-EVA single panel being skived.
Figure 23:
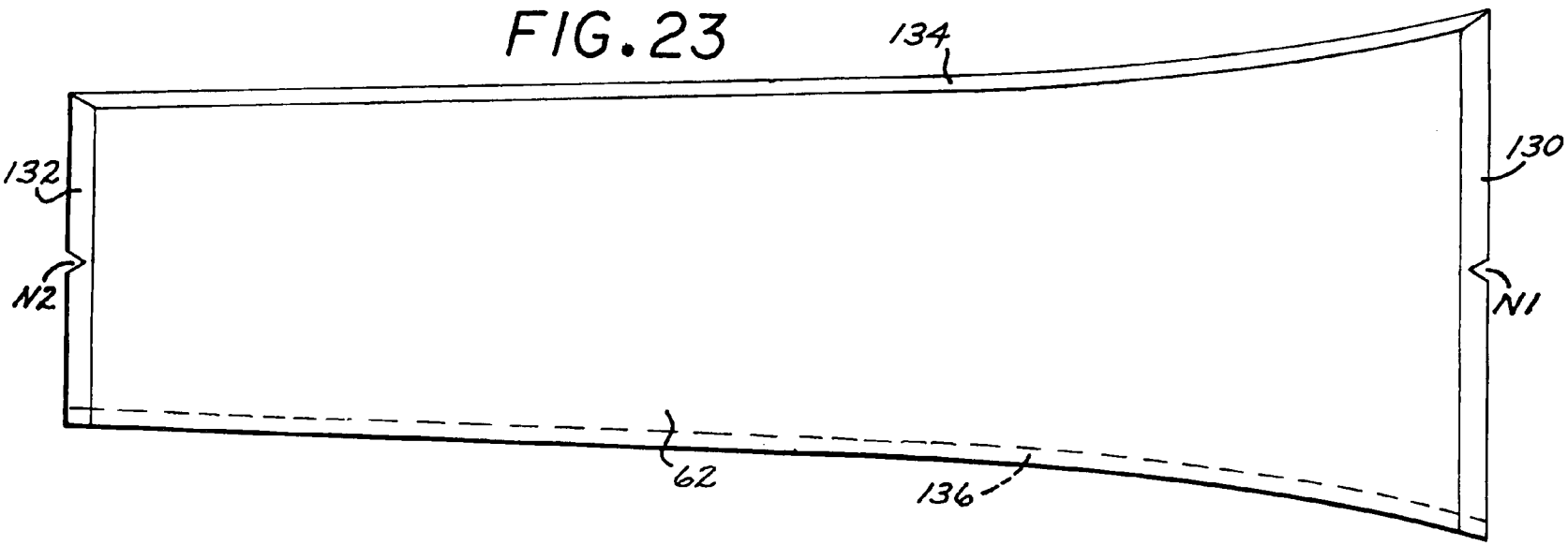
FIG. 23 is a front view of the interior surface of the polyurethane-EVA single panel after the top, bottom and side edges thereof have been skived in the manner depicted in FIGS. 20, 21 and 22.

Referring now to FIGS. 20-23, the peripheral edges of the panel S are shown being skived by a pair of rotating knives 120 and 122, which engage the top edge 107 and bottom edge 108 of the panel S, as shown in FIG. 20, and a single rotating knife 124. Knives 120 and 122 form top and bottom skived edges 130, 132. Knife 124 is shown forming skived side edge 134 on one side of the panel S in FIG. 21 and the other skived side edge 136 in FIG. 22 after the first side 109 has been skived. A pressure plate 83 is utilized to secure the panel S on base 84 during the skiving operation. It will be noted that the skiving on the opposite sides 109, 110 of the panel S are preferably parallel to one another, as seen in FIG. 22. Preferably, the skiving will have a width of about 4.0-6.0 millimeters. In an alternative embodiments, the top edge 107 and/or bottom edge 108 is not skived.

Referring now to FIGS. 24-27, there is shown an underlisting sleeve U formed of a resilient material such as a natural or synthetic rubber or plastic. Sleeve U may include an integral cap 85 at its top end, while the bottom end of the sleeve may be formed with an integral nipple 86. The underside of the cap 85 is preferably formed with a circumferentially downwardly extending slot 87. The slot 87 preferably receives the top skived edge 130 of the panel S as described hereinafter. The nipple 86 is preferably formed with an upwardly extending slot 88 which is preferably defined by a peripheral lip 89 formed outwardly of the slot 88 so as to admit the bottom skived edge 132 of the panel S in a manner to be described hereinafter. Preferably, underlisting sleeve U will be formed with centering notches N3, N4 indicating a middle point for application of the completed grip panel S to the underlisting sleeve U to form a complete grip G. Alternatively, underlisting sleeve U may be formed with a vertically extending score line SL-2 (not shown).

Figure 28:
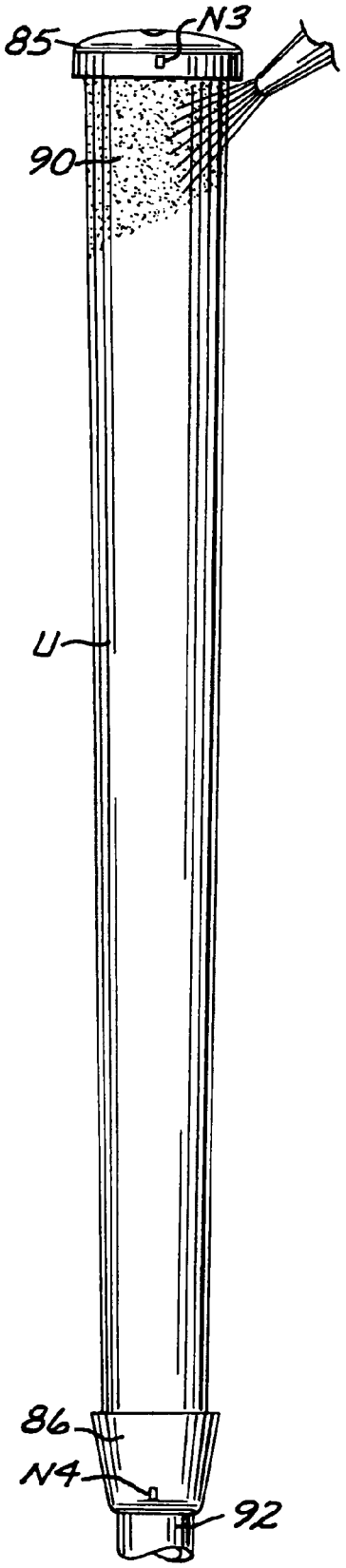
FIG. 28 is a front view showing one version of adhesive being applied to the exterior surface of the underlisting sleeve.
Figure 29:
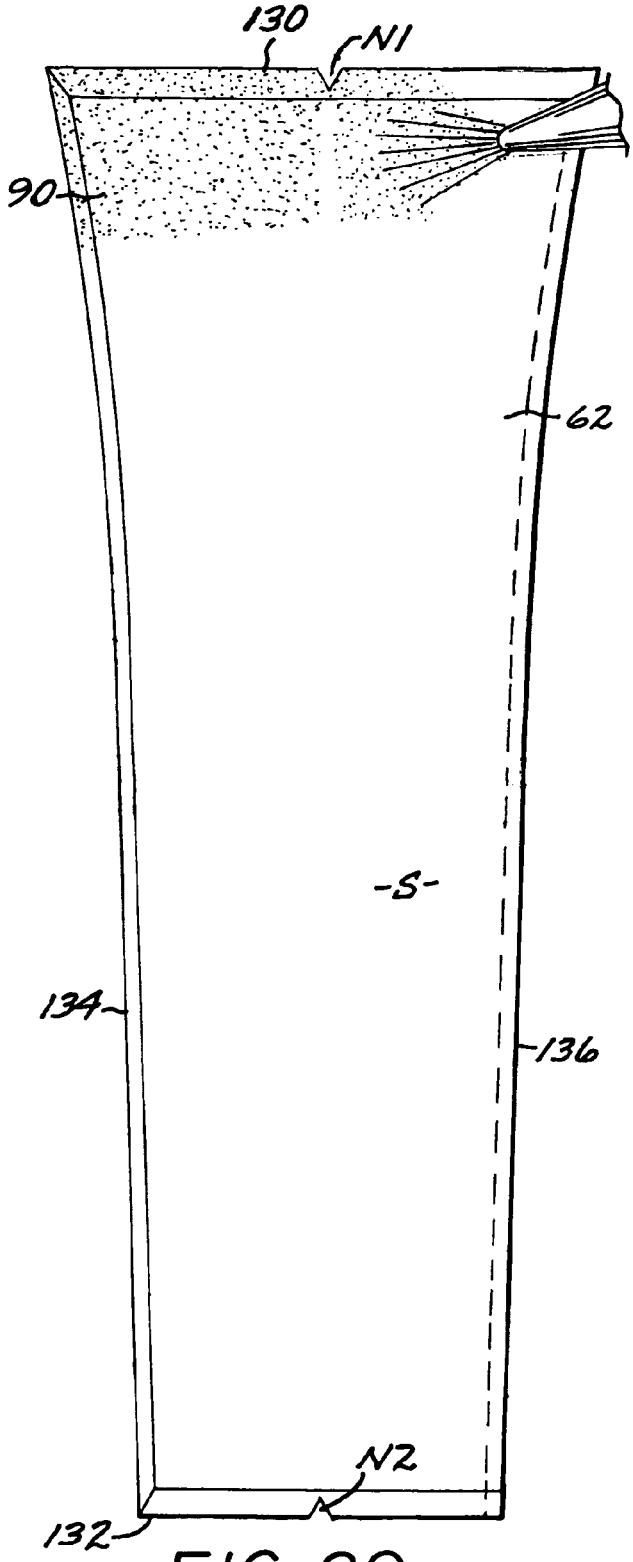
FIG. 29 is a front view showing one version of adhesive being applied to the interior surface of the polyurethane-EVA single panel.

Referring now to FIGS. 28-37, the panel S is shown being applied to underlisting sleeve U. In FIG. 28, the exterior surface of the underlisting sleeve U is shown receiving an adhesive 90 by means of a nozzle, brush or the like. In FIG. 29, the interior surface of the EVA layer 62 is shown receiving an adhesive 90 by means of a nozzle, brush or the like.

Figure 30:
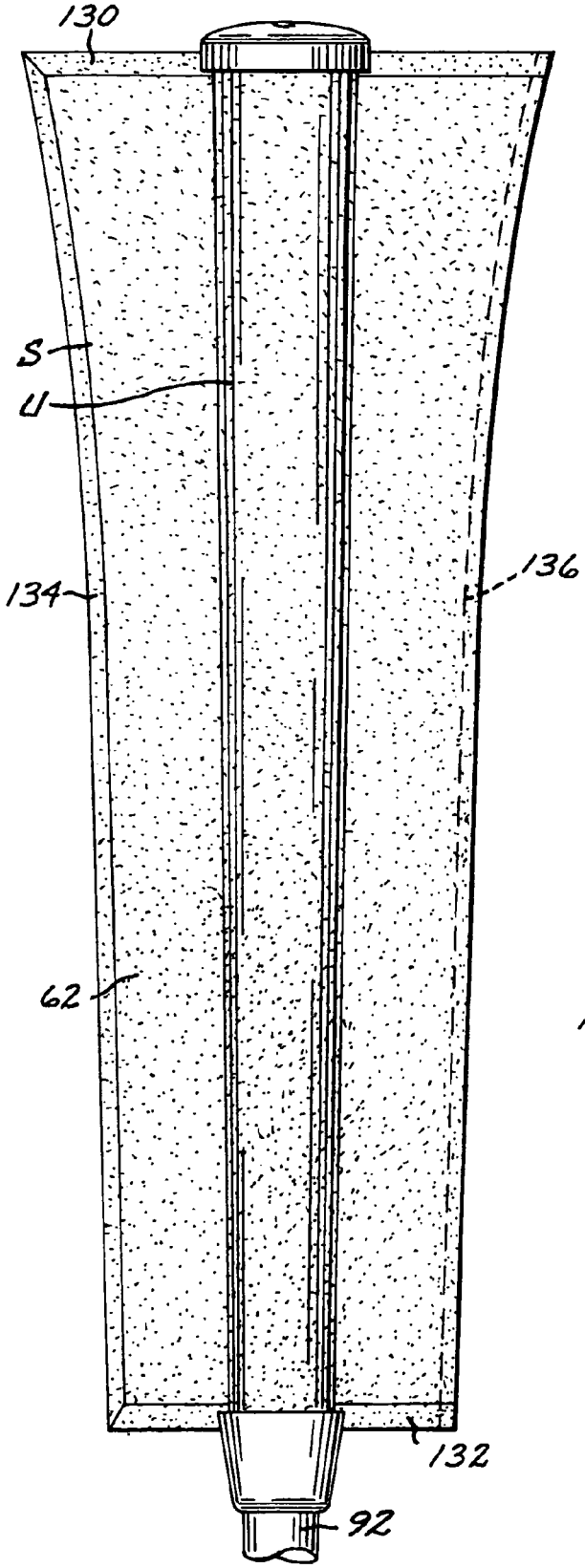
FIG. 30 is a front view showing a first step in wrapping and adhering the polyurethane-EVA single panel to an underlisting sleeve.
Figure 31:
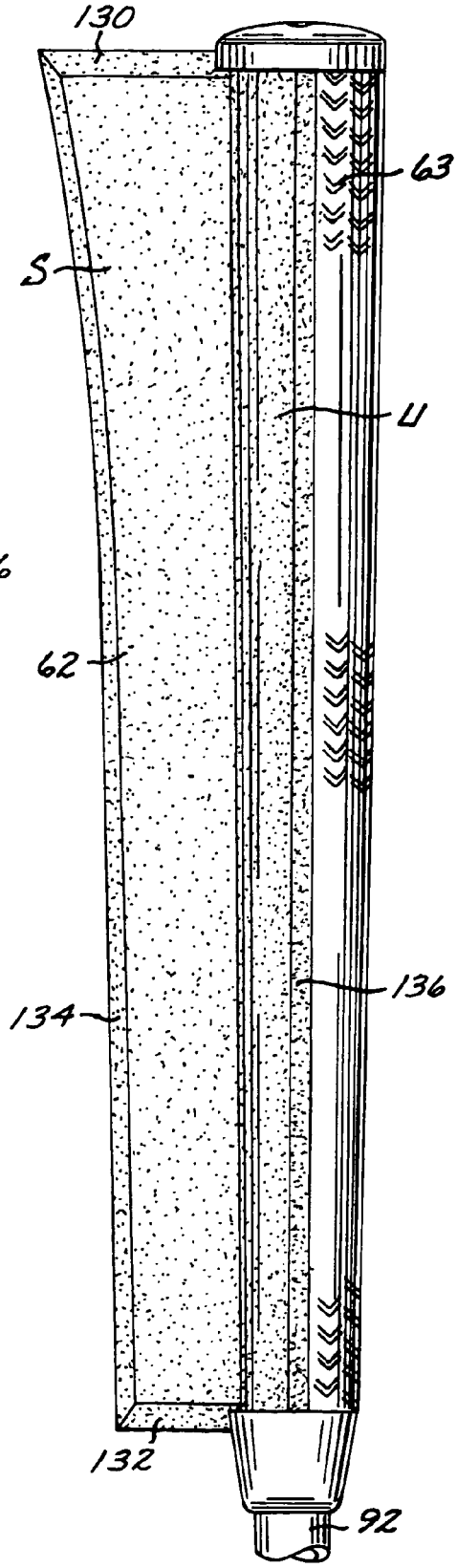
FIG. 31 is a front view showing a second step in wrapping and adhering the polyurethane-EVA single panel to an underlisting sleeve.

FIG. 30 shows the panel S shown being wrapped around and adhered to the underlisting sleeve U. During this operation, the notches N1, N2 of the panel S are disposed in alignment under notches N3, N4 of the underlisting sleeve U. Alternatively, the score lines SL-1 and SL-2 may be disposed in alignment. In yet another embodiment, score lines may be used in combination with notches to center the panel S on the underlisting sleeve U. Also, top skived edge 130 of the panel S will be manually inserted within the slot 87 of the underlisting cap 85, while the bottom skived edge 132 of the panel S is manually inserted within the slot 88 formed within the nipple 86 by temporarily flexing the peripheral lip 89 outwardly (See FIGS. 43 and 44).

Figure 35:
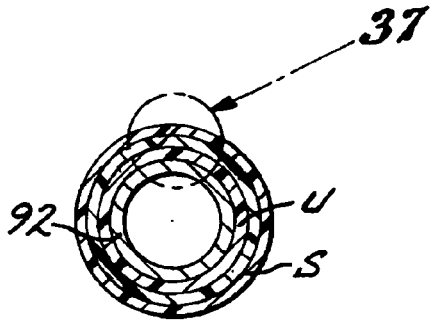
FIG. 35 is a horizontal cross-sectional view taken along the line designated 35-35 of FIG. 32.
Figure 37:
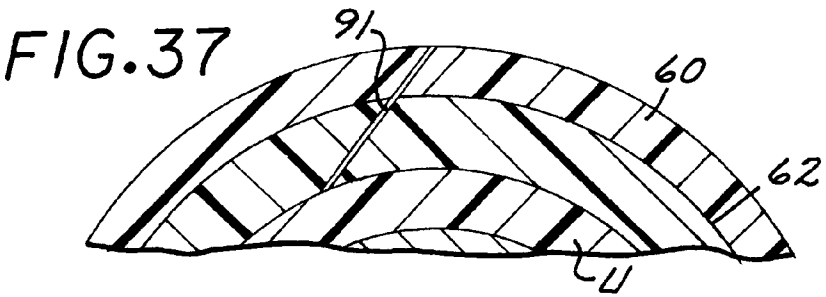
FIG. 37 an enlarged view of the encircled area designated 37 in FIG. 35 showing a seam between the side edges of one embodiment of the single panel.
Figure 36:
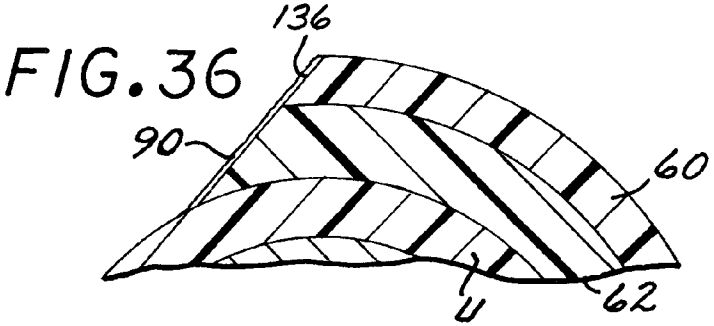
FIG. 36 an enlarged view of the encircled area designated 36 in FIG. 34.

As indicated in FIGS. 35, 36 and 37, the skived side edges 134, 136 of the panel S will be adhered together by a suitable adhesive 90 so as to define a seam 91 extending through the panel. Because of the skived side edges 134, 136, the seam 91 extends through the panel at an angle relative to the depth of the panel S so as to increase the length of such seam as compared to a seam extending parallel to the depth of the panel. Increased length of the seam affords a stronger bond. As one of skill in the art would appreciate and as discussed in my earlier disclosures, there are different ways of attaching the panel to the underlisting sleeve U. A suitable adhesive 90 used to join the EVA layers and to wrap the polyurethane/EVA panel to the underlisting is preferably a combination of methyl-ethyl-kentone ($C_6H_5CH_3$) and T1008 polyurethane. As those of skill in the art will appreciate, these compounds can be combined in various ratios. However, one suitable ratio of the combination is 8:1. As one of skill in the art would appreciate and as stated in the disclosure of my U.S. Pat. No. 6,627,027, one can purchase EVA having an adhesive coating 30 covered by a protective paper from the Ho Ya Electric Bond Factory, Xin Xing Ind. Area. Xin Feng W. Rd., Shi Jie Town Dong Guan City, Guan Dong, Province, China. Still other possibilities are contemplated for securing the panel S to the underlisting U, including, but not limited to, the use of a tape, rather than liquid, form of adhesive 90.

Figure 32:
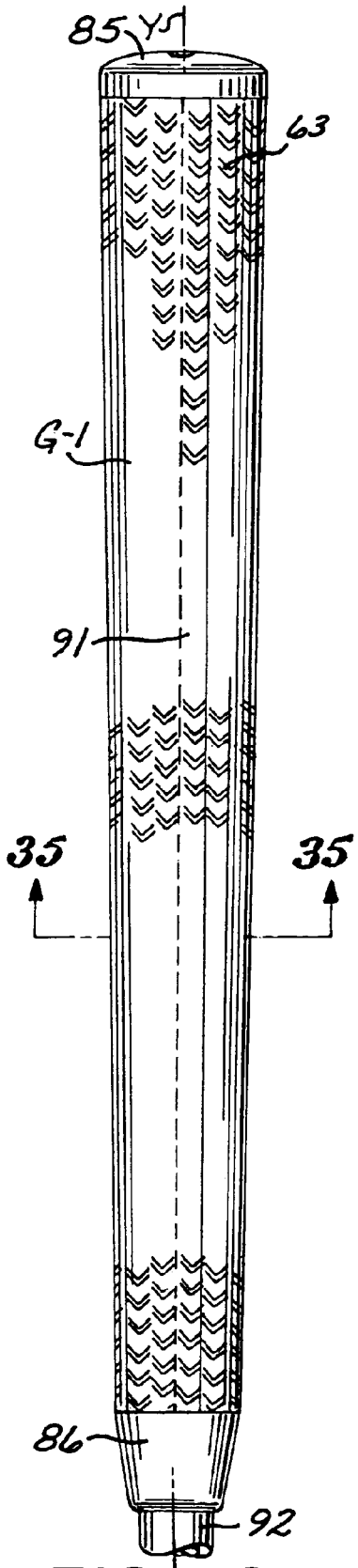
FIG. 32 is a front view showing the polyurethane-EVA single panel adhered to an underlisting sleeve.
Figure 33:
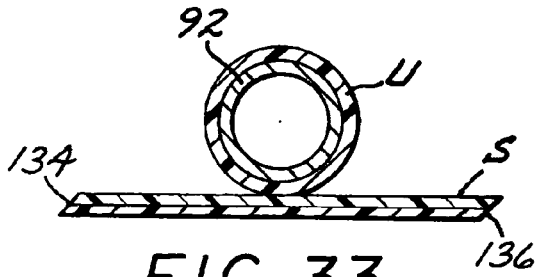
FIG. 33 is a horizontal cross-sectional view taken along the line designated 33-33 of FIG. 30.
Figure 34:
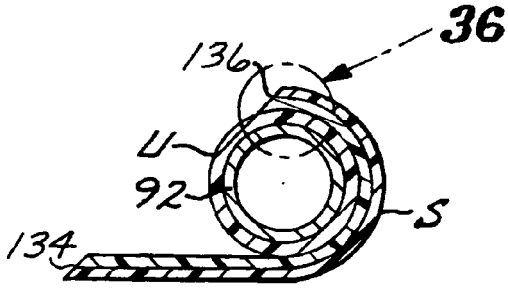
FIG. 34 is a horizontal cross-sectional view taken along the line designated 34-34 of FIG. 31.

In one embodiment, the seam 91 is left alone and the completed grip G-1 resembles the grip in FIG. 32.

FIGS. 43 and 44 show enlarged cross-sectional views along the lines designated 43-43 and 44-44, respectively, of FIG. 42. They demonstrate the final placement of the top skived edge 130 and the bottom skived edge 132 of the panel S after the panel S has been adhered to the underlisting U. It will be seen that the top edge skived edge 130 of the panel S is securely disposed within the cap 85 slot 87. Similarly, the bottom skived edge 132 is securely disposed within the nipple 86 slot 88. It is, of course, also possible to insert unskived top edge 107 and/or unskived bottom edge 108 into the respective slot 87 or 88. The complete grip is then removed from the mandrel 92 and is ready to be slipped onto and adhered to the shaft of a golf club GC or putter P in a conventional manner.

Figure 38:
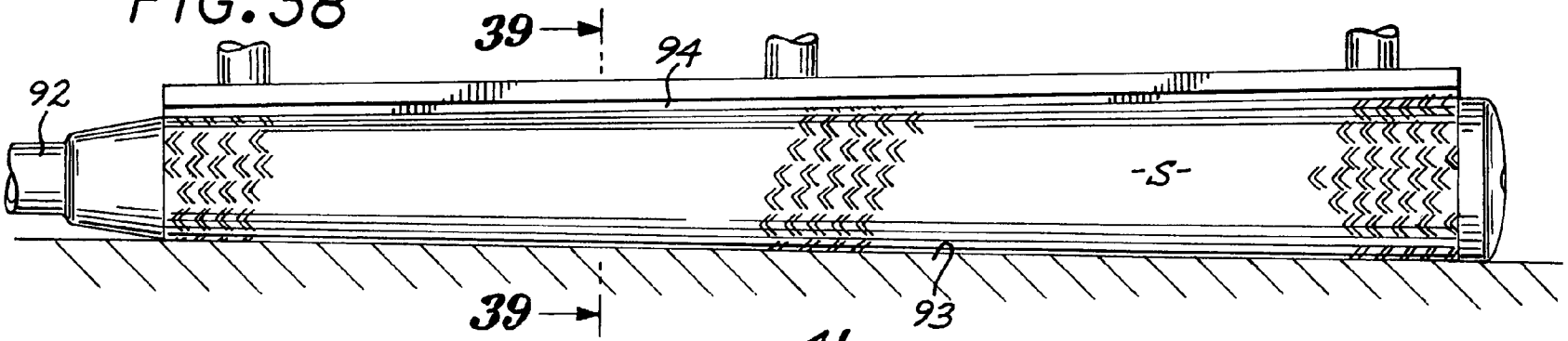
FIG. 38 is a side view showing a heat depressed sealing channel being formed along the top portion of the seam shown in FIG. 37.
Figure 41:
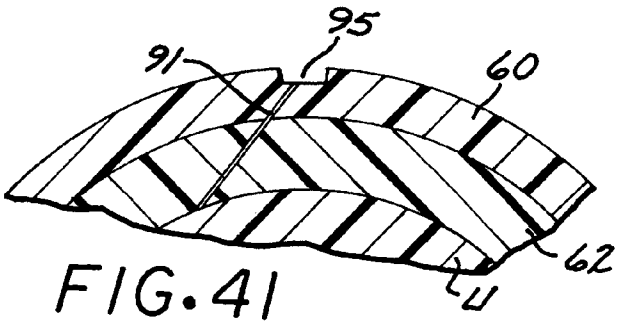
FIG. 41 an enlarged view of the encircled area designated 41 in FIG. 40.
Figure 40:
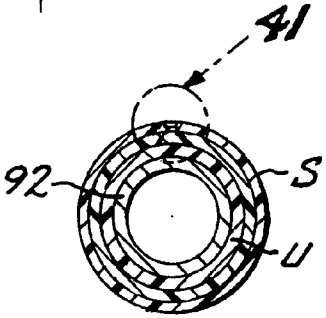
FIG. 40 shows the parts of FIG. 39 after the sealing channel has been formed.
Figure 39:
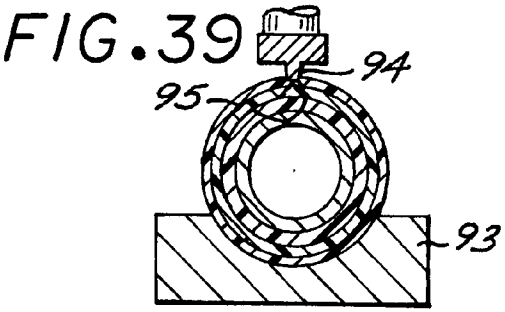
FIG. 39 is a vertical cross-sectional view taken along the line designated 39-39 of FIG. 38.
Figure 49:
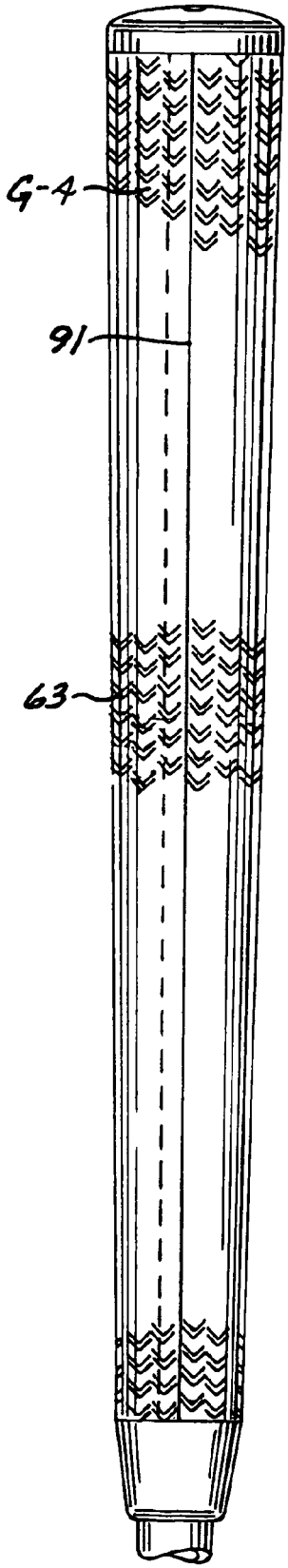
FIG. 49 is a front view of a polyurethane-EVA single panel grip as in FIG. 32, ready for modification.

Referring to FIGS. 38-42, an embodiment is shown after the panel S has been adhered to the underlisting sleeve U. FIG. 38 shows the underlisting sleeve U supported by mandrel 92 upon a base 93 while a longitudinally extending heated pressure tooth 94 (FIG. 39) is urged against the polyurethane layer 60 at the outer edge of seam 91. The heated tooth 94 forms a small depression 95 in the polyurethane layer 60 aligned with the outer edge of the seam 91 so as to further strengthen the seam 91. An embodiment of a completed grip G-2 is shown in FIG. 42.

FIGS. 45-48 show a golf club grip G-3 similar to grip G-2 with the exception that the depression 95 is filled with hot polyurethane 96 by a nozzle, brush or the like (FIG. 45). After the polyurethane 96 hardens, it can be buffed by a suitable brush or the like 97 to smoothly blend into the surface of the grip as shown in FIG. 46. Alternatively, channel 95 is not buffed after it is filled with hot polyurethane 96.

Figure 50:
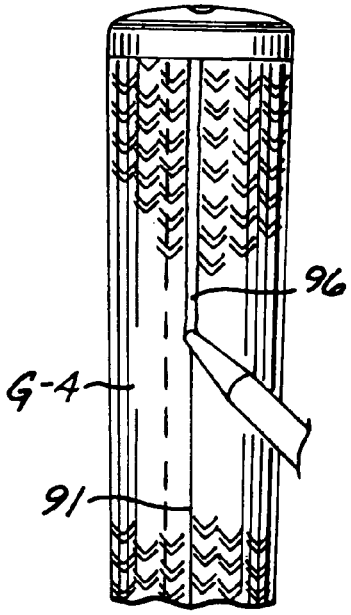
FIG. 50 is a broken front view showing a first step in making a modification of the grip of FIG. 49.
Figure 51:
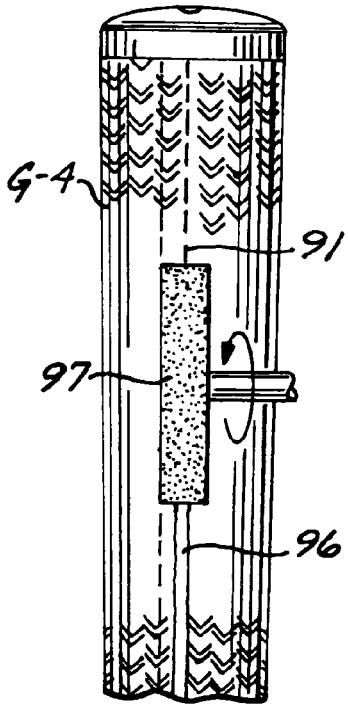
FIG. 51 is a broken front view showing a second step in making a modification of the grip of FIG. 49.
Figure 52:
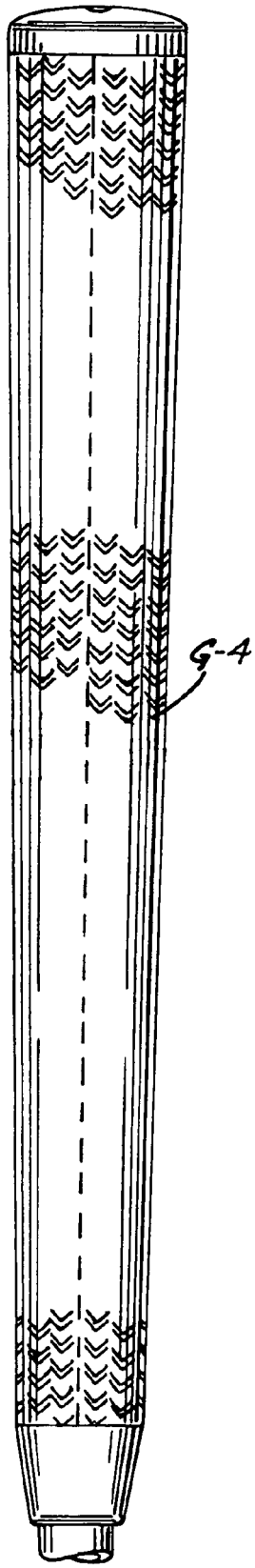
FIG. 52 is a front view of a grip made in accordance with FIGS. 49-51.

Referring now to FIGS. 49-52, there is shown another embodiment of a grip G-4. Grip G-4 does not use the channel 95. Rather, seam 91 is coated by a small deposite of hot polyurethane 96 by means of a nozzle, brush or the like, as shown in FIG. 50. After the polyurethane 96 hardens, it may be buffed by a suitable brush or the like 97 to smoothly blend into the surface of the grip, as indicated in FIG. 51. Alternatively, the polyurethane 96 is not buffed.

In still another embodiment, the adhesive 90 is sprayed on the EVA layer 62 such that it covers only the EVA layer 62 and does not extend to cover the edges of the polyurethane layer 60. After the panel S is wrapped around the underlisting sleeve U, hot polyurethane 96 may be injected between the polyurethane layers of the seam 91 by a needle, brush, sprayer or the like. After the polyurethane 96 hardens, it may be buffed by a suitable brush or the like 97 to smoothly blend in the surface of the grip any polyurethane 96 spilling from the seam. Alternatively, the polyurethane is not buffed.

Figure 53:
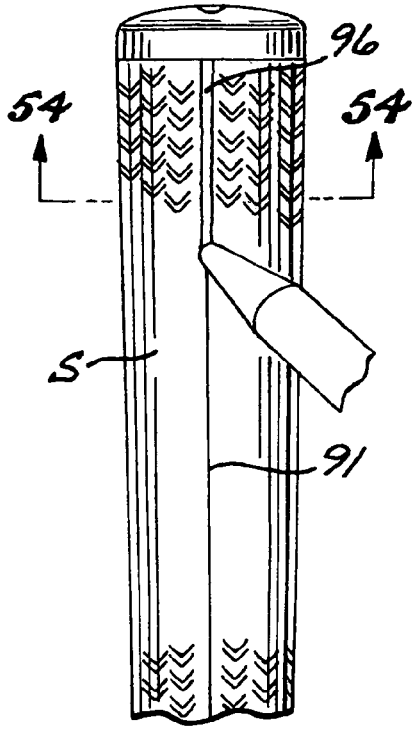
FIG. 53 is a broken front view showing another modification of the grip shown in FIG. 49.
Figure 56:
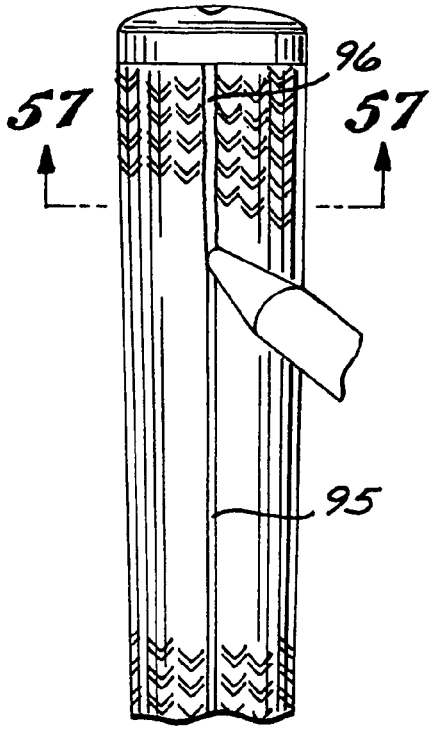
FIG. 56 is a broken front view showing another modification of the grip shown in FIG. 49.
Figure 54:
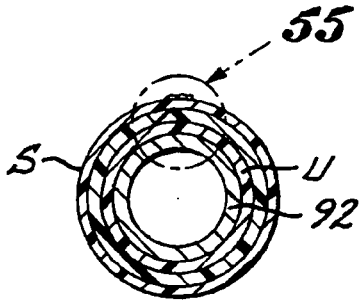
FIG. 54 is a horizontal cross-sectional view taken along the line designated 54-54 of FIG. 53.
Figure 57:
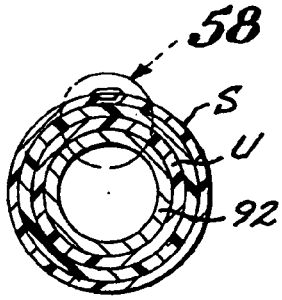
FIG. 57 is a horizontal cross-sectional view taken along the line designated 57-57 of FIG. 56.
Figure 55:
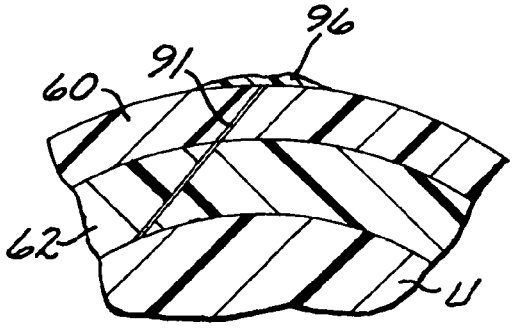
FIG. 55 an enlarged view of the encircled area designated 55 in FIG. 54.
Figure 58:
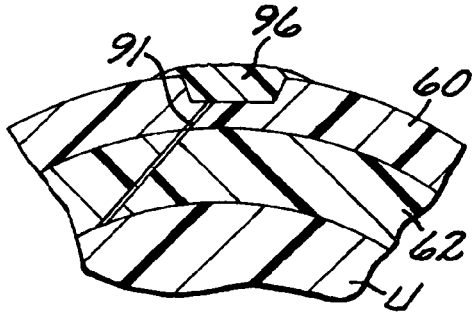
FIG. 58 an enlarged view of the encircled area designated 58 in FIG. 57.
Figures 59, 60, 61, 62, 63:
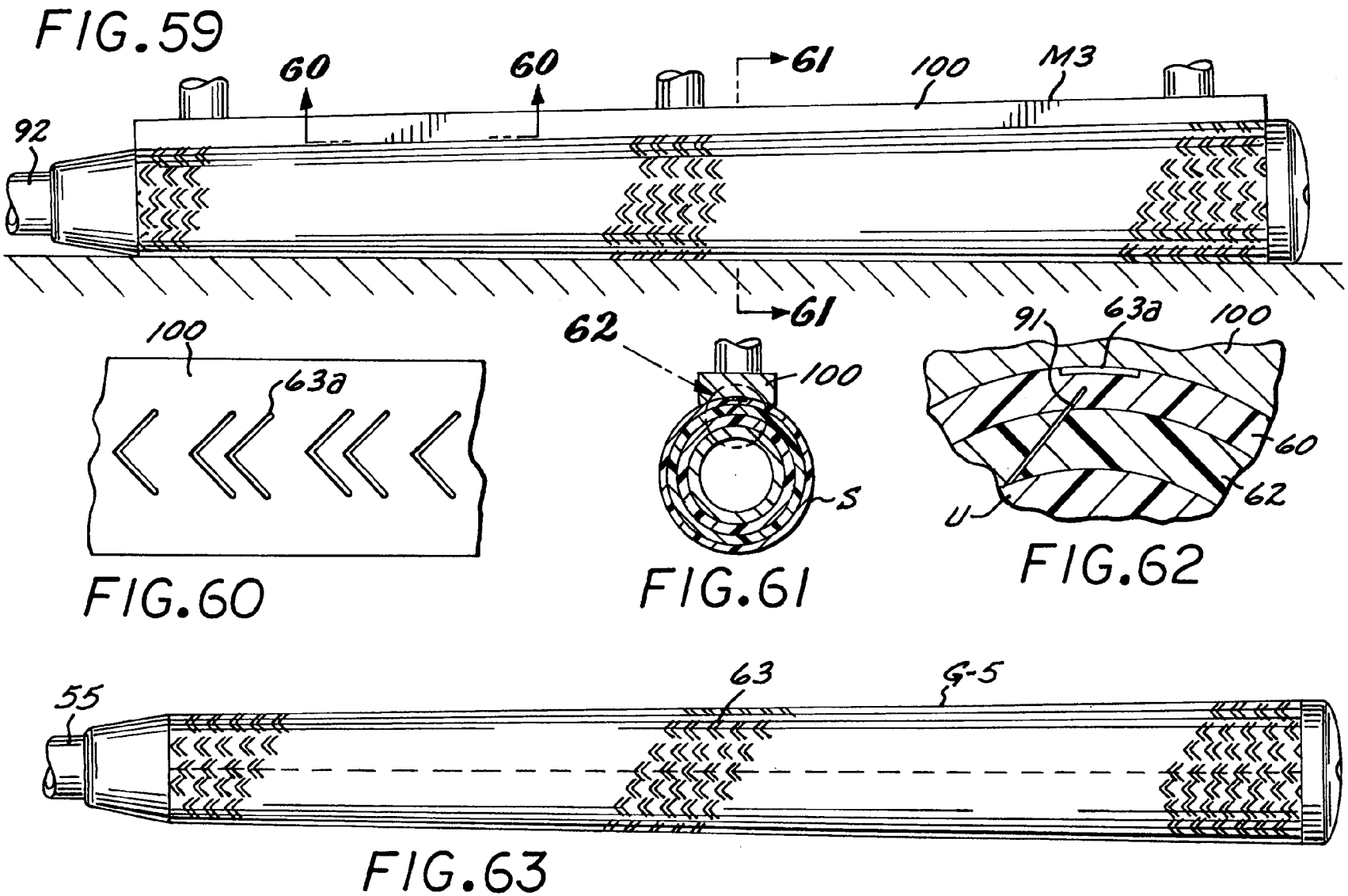
FIG. 59 is a side view of a die that can be utilized in modifying embodiments of the present invention.
FIG. 60 is a horizontal cross-sectional view taken along the line designated 60-60 of FIG. 59.
FIG. 61 is a vertical cross-sectional view taken along the line designated 61-61 of FIG. 59.
FIG. 62 an enlarged view of the encircled area designated 62 in FIG. 61.
FIG. 63 is a front view of a grip made in accordance with FIGS. 59-62.
Figure 64:
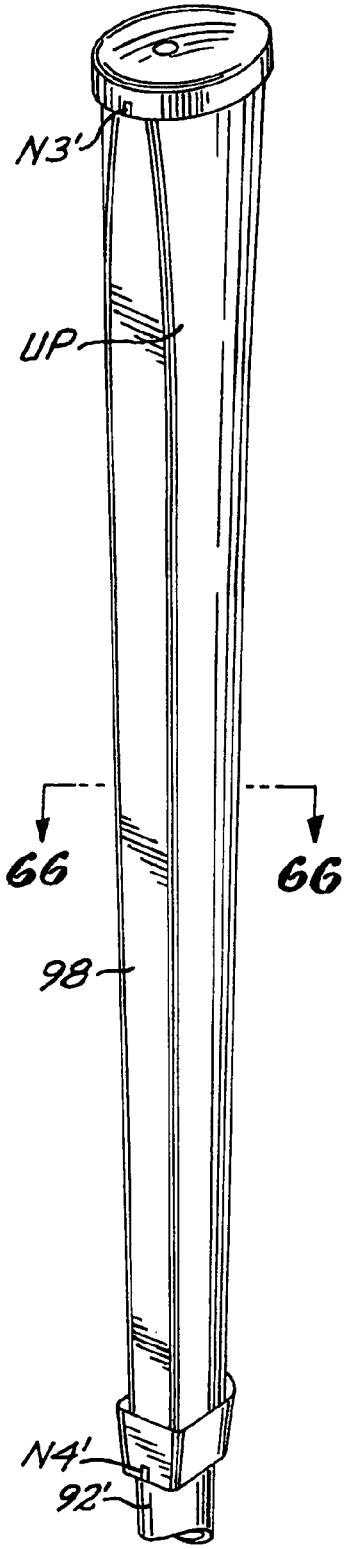
FIG. 64 is a perspective front view of an underlisting sleeve of a putter grip according to an embodiment of the present invention.
Figure 65:
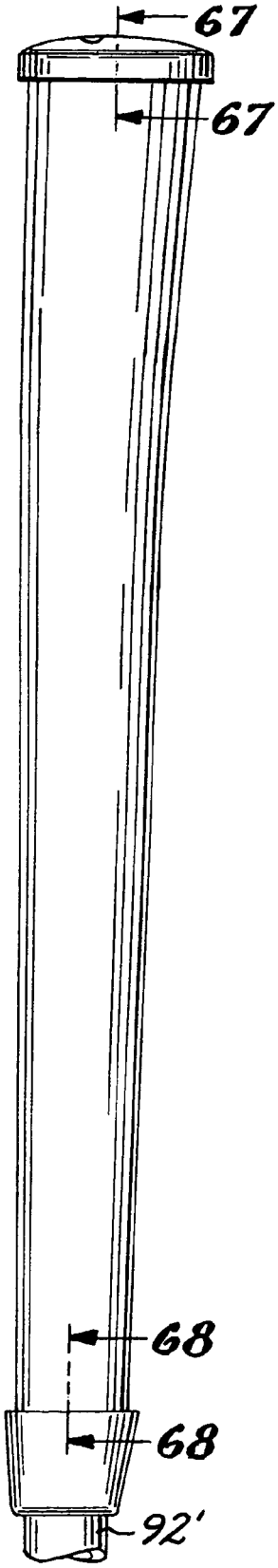
FIG. 65 is a side view of the underlisting sleeve of FIG. 64.
Figure 66:
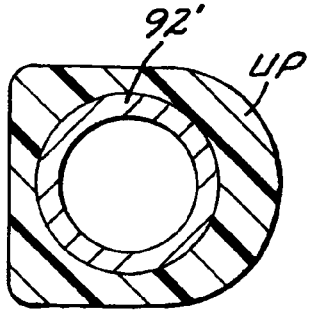
FIG. 66 is a horizontal cross-sectional view taken along the line designated 66-66 of FIG. 64.
Figure 67:
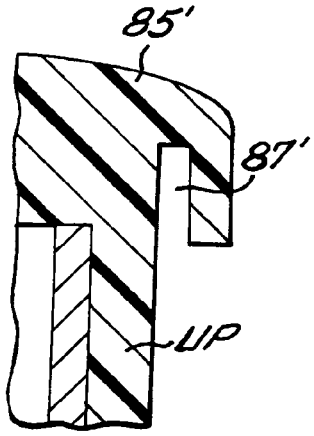
FIG. 67 is a vertical cross-sectional view taken along the line designated 67-67 of FIG. 65.
Figure 68:
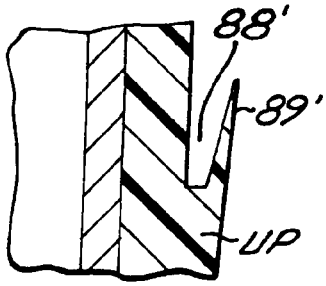
FIG. 68 is a vertical cross-sectional view taken along the line designated 68-68 of FIG. 65.

Referring to FIGS. 53-63, there is shown a modification of the grips of FIGS. 32-52. In FIGS. 53-55, hot polyurethane 96 is shown being coated over the seam 91 by a nozzle, brush or the like. In FIGS. 56-58, hot polyurethane 96 is shown filling the depression 95 by a nozzle, brush or the like. In another embodiment, hot polyurethane 96 is injected between the edges of the polyurethane layer along the seam. FIG. 59 shows a third mold M3 having a heated platen 100, the underside of which is formed with a segment 63*a* of the friction enhancing pattern 63, which is embossed on the surface of the polyurethane layer 60 of the grip. The heated platen 100 is depressed against the outside surface of the polyurethane layer 60 over the area of the seam 91 while the polyurethane deposit 96 is still hot. With this arrangement, the area of the exterior of the polyurethane layer 60 outwardly of the seam 91 is formed with the friction enhancing segment 63*a* of FIG. 60 whereby the segment 63*a* merges with the friction enhancing pattern 63 previously molded on the polyurethane layer 60 of the grip G. FIG. 63 shows such a grip G-5 with the merged friction enhancing pattern 63 placed over and adhered to the shaft 55 of a golf club GC. Alternatively, in another embodiment, the heated platen 100 may be urged against the naked seam 91 to form the friction enhancing pattern without first coating in or along the seam 91 with hot polyurethane 96. Pressing the friction enhancing pattern 63 directly to the seam 91 eliminates a step in the production process and therefore reduces the costs of production.

Figure 69:
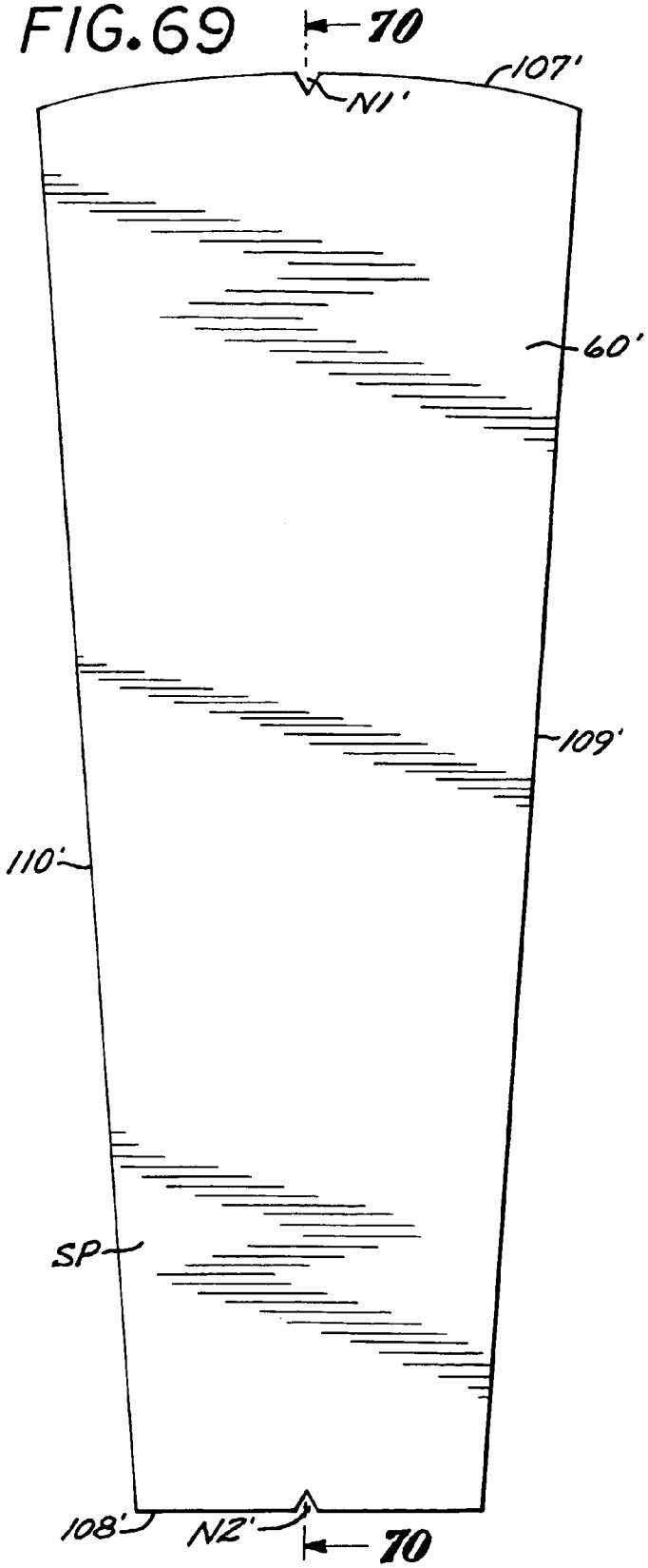
FIG. 69 is a front view of the polyurethane-EVA single panel of a golf club putter grip according to an embodiment of the present invention.
Figure 70:
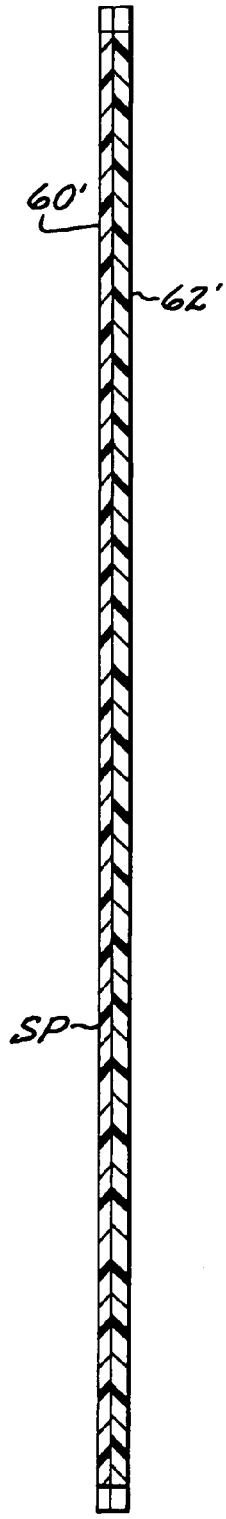
FIG. 70 is a vertical cross-sectional view taken along the line designated 70-70 of FIG. 69.
Figure 71:
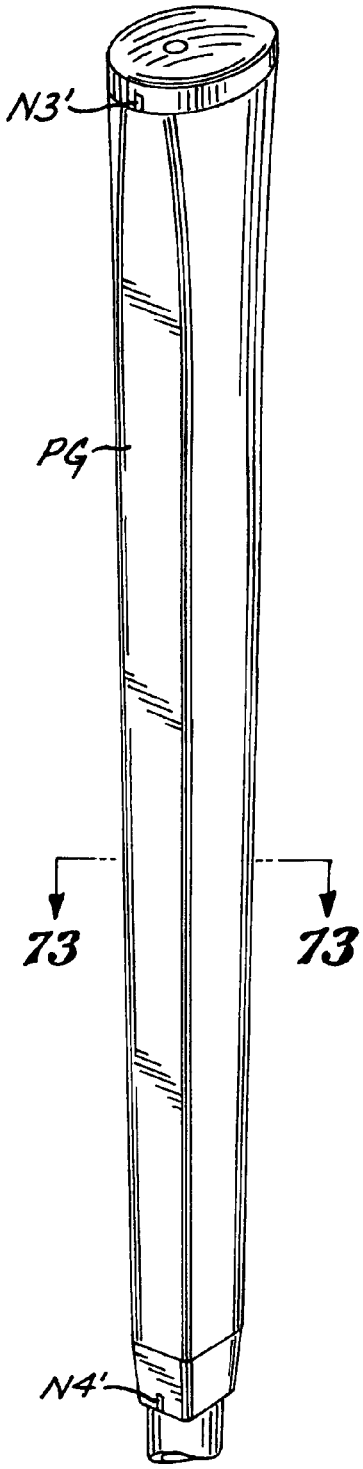
FIG. 71 is a perspective front view of a completed polyurethane-EVA single panel putter grip according to an embodiment of the present invention.
Figure 72:
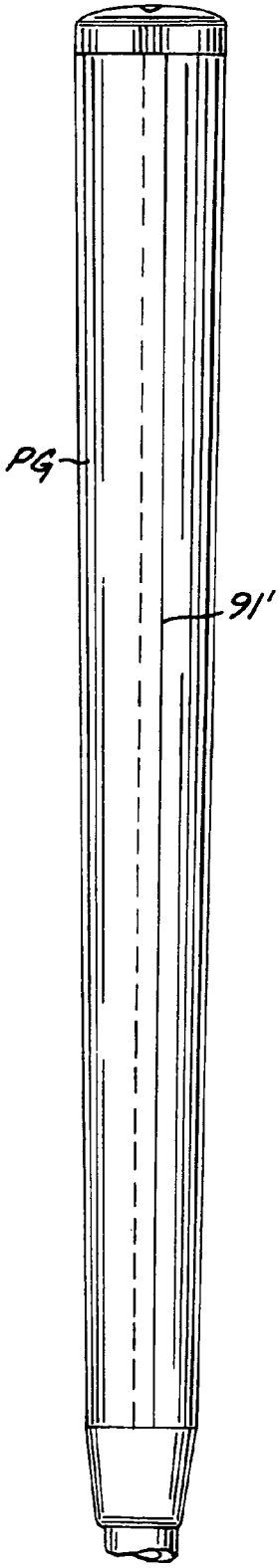
FIG. 72 is a front view of the putter grip of FIG. 71.
Figure 73:
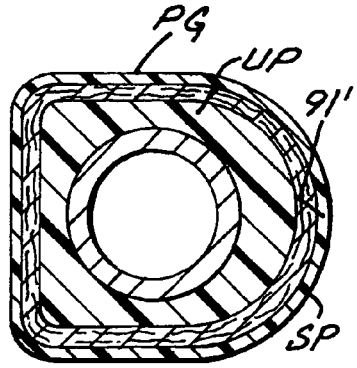
FIG. 73 is a horizontal cross-sectional view taken along the line designated 73-73 of FIG. 71.

Referring now to FIGS. 64-73, there is shown a polyurethane-EVA single panel grip PG for use with a conventional putter P. The grip PG includes a resilient underlisting UP (FIGS. 64-68), which is generally similar to the aforedescribed underlisting U, except that underlisting sleeve UP is not of an annular configuration. Instead, the front surface 98 of underlisting sleeve UP is of flat configuration in accordance with the design of most putters in general use. It should be understood that underlisting sleeve UP receives a single panel SP of polyurethane-EVA configuration, similar to the aforedescribed single panel S. Such single panel SP is wrapped about and adhered to the underlisting sleeve in the same manner as described hereinbefore with respect to the panel P in the polyurethane-EVA single panel grips G-1-G-5, with like parts of the two grips marked with like reference numerals. Similarly, if a tooth 94' is used to create a channel 95', that channel 95' may be left alone or filled with hot polyurethane 96' and left alone or buffed with a brush or the like 97' (refer to FIGS. 38-63 for examples of possible modifications to the grips herein disclosed). In one embodiment, the panel SP is smooth as shown in FIG. 69. Because a putter P is generally subjected to less forces due to the shortened putting swing as compared to the generally longer swing associated with other clubs, it is contemplated that putter grip PG does not require the friction enhancing pattern 63'. Alternatively, the panel SP may incorporate a smaller heat embossed visual indicial such as logo 114' (not shown), a heat embossed friction enhancing pattern 63' (not shown), an inked visual indicia 118' (not shown), a larger heat embossed pattern extending the majority of the length of the panel 118' (not shown) or any combination or modification thereof.

It should be understood that the outer surface of a grip embodying the present invention may be coated by means of a brush, nozzle, sprayer or the like with a thin layer of polymeric material, preferably polyurethane (not shown), to protect such surface, add tackiness thereto and increase the durability thereof.

Golf club grips of the present invention provide several advantages over existing wrapped grips and single panel grips. Additionally, such grips have the appearance of molded, one-piece grips familiar to professional and low-handicap golfers. Although some of such golfers are reluctant to use a non-traditional wrapped club, they are willing to play with a structurally integral grip of the present invention since such grip affords the shock-absorbing and tackiness qualities of a wrapped grip. Further, the use of a polymeric material such as EVA as the inner layer lightens the grip of the club and prevents undue absorption of moisture into the grip of the club.

Various modifications and changes may be made with respect to the foregoing detailed description without departing from the spirit of the present invention.

What is claimed is:

1. A grip for the handle of a golf club, such grip comprising:

a resilient underlisting sleeve that is telescopically slipped onto the handle of a golf club;

a single panel that includes a polyurethane outside layer bonded to an EVA inside layer, such panel having a configuration corresponding to the exterior shape of the resilient sleeve;

a friction enhancing pattern formed on the outside of the outside layer;

the single panel being wrapped about and adhered to the underlisting;

with the side edges of the panel abutting one another to define a longitudinal seam extending from the interior surface of the inside panel to the exterior surface of the outside layer;

a heat depressed channel formed in the outside layer exteriorially of the seam to reinforce the seam;

a polyurethane deposit over the seam; and a segment of the friction enhancing pattern formed outwardly of the seam so as to merge with the friction enhancing pattern formed on the outside of the outside layer.

2. A grip as set forth in claim 1 wherein the seam extends through the panel at a slant.

3. A grip as set forth in claim 1 said outside layer having a thickness of approximately 0.3 to 0.5 mm.

4. A grip as set forth in claim 1 wherein the resilient underlisting sleeve includes a cap formed with a downwardly facing slot and a nipple formed with an upwardly facing circumferential slot, the outer portion of the nipple groove being defined by a peripheral lip, with the top edge of the panel being firmly retained in the cap slot and the bottom edge of the panel being firmly retained in the nipple slot by the peripheral lip.

5. A grip as set forth in claim 1 said inside layer having a thickness of approximately 0.8 to 1.7 mm.

6. A grip as set forth in claim 1 wherein said inside layer is directly adhered to said underlisting sleeve.

7. A grip for the handle of a golf club, such grip comprising:

a resilient underlisting sleeve that is telescopically slipped onto the handle of a golf club;

a single panel that includes a polyurethane outside layer bonded to an EVA inside layer, such panel having a configuration corresponding to the exterior shape of the resilient sleeve;

a friction enhancing pattern formed on the outside of the outside layer;

the single panel being wrapped about and adhered to the underlisting with the side edges of the panel abutting one another to define a longitudinal seam extending from the interior surface of the inside layer to the exterior surface of the outside layer;

a heat depressed channel formed in the outside layer exteriorially of the seam to reinforce the seam;

a polyurethane deposit in the channel; and a segment of the friction enhancing pattern formed in the polyurethane deposit outwardly of the seam so as to merge with the friction enhancing pattern formed on the outside of the outside layer.

8. A grip as set forth in claim 7 wherein the resilient underlisting sleeve includes a cap formed with a downwardly facing slot and a nipple formed with an upwardly facing circumferential slot, the outer portion of the nipple groove being defined by a peripheral lip; and the top edge of the panel being firmly retained in the cap slot and the bottom edge of the panel being firmly retained in the nipple slot by the peripheral lip.

9. A grip as set forth in claim 7 said outside layer having a thickness of approximately 0.3 to 0.5 mm.

10. A method of making a grip for the handle of a golf club, such method including the steps of providing a resilient underlisting sleeve;

providing a single panel that includes a polyurethane outside layer bonded to an EVA inside layer, such panel having a configuration corresponding to the exterior shape of the resilient sleeve;

forming a friction enhancing pattern on the exterior of the outside layer;

wrapping the single panel about and adhering it to the underlisting sleeve, thereby defining a seam;

applying a deposit of polyurethane over the length of the seam; and forming a segment of the friction enhancing pattern over the polyurethane deposit outwardly of the seam whereby the segment merges with the friction enhancing pattern formed on the outside of the outside layer.

11. A method as set forth in claim 10 which includes the further step of forming a heat depressed channel in the outside layer exteriorially of the seam, with such channel receiving the polymeric deposit.

12. A method as set forth in claim 11 wherein the underlisting sleeve includes a cap formed with a downwardly facing slot, and the sleeve also including a nipple formed with an upwardly facing circumferential slot defined by a peripheral lip; and urging the top edge of the panel into the circumferential slot of the cap and the bottom edge of the panel into the circumferential slot of the nipple as the panel is wrapped about the sleeve.

13. A method as set forth in claim 11 which includes the additional step of skiving the side edges of the panel so that the seam extends through the panel at a slanted angle relative to the depth of the panel.

14. A method as set forth in claim 10 wherein the underlisting sleeve includes a cap formed with a downwardly facing slot, and the sleeve also includes a nipple formed with an upwardly facing circumferential slot defined by a peripheral lip; and urging the top edge of the panel into the circumferential slot of the cap and the bottom edge of the panel into the circumferential slot of the nipple as the panel is wrapped about the sleeve.

15. A grip for the handle of a golf club, such grip comprising:

a resilient underlisting sleeve that is telescopically slipped onto the handle of a golf club;

a single panel that includes a polyurethane outside layer bonded to an EVA inside layer, such panel having a configuration corresponding to the exterior shape of the resilient sleeve;

a friction enhancing pattern formed on the outside of the outside layer;

the single panel being wrapped about and adhered to the underlisting sleeve; and with the side edges of the panel abutting one another to define a longitudinal seam extending from the interior surface of the inside layer to the exterior surface of the outside layer; and a polyurethane deposit along the seam, wherein the grip further comprises a segment of the friction enhancing pattern formed outwardly of the seam so as to merge with the friction enhancing pattern formed on the outside of the outside layer.

16. A grip as set forth in claim 15 wherein the seam extends through the panel at a slant.

* * * * *

UNITED STATES PATENT AND TRADEMARK OFFICE

CERTIFICATE OF CORRECTION

PATENT NO. : 7,585,230 B2
APPLICATION NO. : 10/875035
DATED : September 8, 2009
INVENTOR(S) : Ben Huang It is certified that error appears in the above-identified patent and that said Letters Patent is hereby corrected as shown below:

At Column 8, Line 29, please change "T1008" to --TS008--.

At Column 10, Line 38, in Claim 1, please change "that is" to --configured to be--.

At Column 11, Line 9, in Claim 7, please change "that is" to --configured to be--.

At Column 12, Line 31, in Claim 15, please change "that is" to --configured to be--.

Signed and Sealed this
Twenty-second Day of February, 2011

David J. Kappos

David J. Kappos
*Director of the United States Patent and Trademark Office*